US006947685B2

(12) United States Patent
Arimitsu et al.

(10) Patent No.: US 6,947,685 B2
(45) Date of Patent: Sep. 20, 2005

(54) PROCESS CARTRIDGE AND ELECTROPHOTOGRAPHIC IMAGE FORMING APPARATUS

(75) Inventors: Takeshi Arimitsu, Odawara (JP); Jun Miyamoto, Mishima (JP); Kouji Miura, Mishima (JP); Hideki Maeshima, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/329,476

(22) Filed: Dec. 27, 2002

(65) Prior Publication Data

US 2003/0147667 A1 Aug. 7, 2003

(30) Foreign Application Priority Data

Dec. 28, 2001 (JP) ..... 2001/399103

(51) Int. Cl.[7] ..... G03G 15/00; G03G 21/18
(52) U.S. Cl. ..... 399/111; 399/12
(58) Field of Search ..... 399/111, 110, 399/113, 116, 12, 13

(56) References Cited

U.S. PATENT DOCUMENTS

| | | | | |
|---|---|---|---|---|
| 6,532,030 | B2 * | 3/2003 | Okano et al. | 399/12 X |
| 2001/0016123 | A1 * | 8/2001 | Yoshimura | 399/111 X |
| 2002/0025186 | A1 * | 2/2002 | Karakama et al. | 399/111 |
| 2002/0164168 | A1 * | 11/2002 | Hayakawa | 399/12 |
| 2003/0002880 | A1 * | 1/2003 | Kimizuka et al. | 399/12 |
| 2003/0049036 | A1 * | 3/2003 | Ueno et al. | 399/25 |

FOREIGN PATENT DOCUMENTS

| | | | |
|---|---|---|---|
| EP | 0 913 745 | A2 | 5/1999 |
| EP | 1 014 680 | A2 | 6/2000 |
| EP | 1 182 520 | * | 2/2002 |
| JP | 11-348375 | * | 12/1999 |
| JP | 2000-181325 | | 6/2000 |
| JP | 2001-22230 | | 1/2001 |
| JP | 2001-117309 | * | 4/2001 |
| JP | 2002-072782 | * | 3/2002 |
| JP | 2002-072826 | * | 3/2002 |
| JP | 2002-156890 | * | 5/2002 |

* cited by examiner

*Primary Examiner*—Sophia S. Chen
(74) *Attorney, Agent, or Firm*—Fitzpatrick, Cella, Harper & Scinto

(57) ABSTRACT

A process cartridge detachably mountable to a main assembly of an electrophotographic image forming apparatus includes an electrophotographic photosensitive drum; a processor actable on the electrophotographic photosensitive drum; a memory member for storing information about the process cartridge and for communicating with a communicator provided in the main assembly of the electrophotographic image forming apparatus; a cartridge frame supporting the electrophotographic photosensitive drum, the processor and the memory member, wherein the memory member is provided on a surface which crosses with an axis of the electrophotographic photosensitive drum, and when the process cartridge is mounted to the main assembly of the apparatus, the process cartridge is urged by an urging member provided in the main assembly in a direction from a side provided with the memory member to a side opposite therefrom.

17 Claims, 14 Drawing Sheets

PROCESS CARTRIDGE AND ELECTROPHOTOGRAPHIC IMAGE FORMING APPARATUS

FIELD OF THE INVENTION AND RELATED ART

The present invention relates to a process cartridge employed by a copying machine, a printer, etc., employing an electrophotographic method. It also relates to an electrophotographic image forming apparatus employing such a process cartridge. In particular, the present invention relates to such a process cartridge that comprises a single or plurality of memories, and an electrophotographic image forming apparatus in which such a process cartridge is removably mountable.

Herein, an electrophotographic image forming apparatus means an apparatus which forms images on recording medium with the use of an electrophotographic method. It includes, for example, an electrophotographic copying machine, an electrophotographic printer, (for example, laser beam printer, LED printer, etc.) a facsimileing apparatus, a wordprocessor, etc.

A process cartridge means a cartridge in which a charging means, a developing means or a cleaning means, and an electrophotographic photoconductive drum are integrally disposed, and which is removably mountable in the main assembly of an electrophotographic image forming apparatus. It also means a cartridge in which at least one processing means among a charging means, a developing means, and cleaning means, and an electrophotographic photoconductive member, are integrally disposed, and which is removably mountable in the main assembly of an electrophotographic image forming apparatus, and a cartridge in which a least a developing means and an electrophotographic photoconductive drum are integrally disposed, and which is removably mountable in the main assembly of an electrophotographic image forming apparatus.

A memory means a component which is attached to a process cartridge, and stores the information regarding the process cartridge. As the storage element for a memory, a nonvolatile memory, for example, a FeRAM, a ferromagnetic memory, etc., are used.

In an electrophotographic image forming apparatus (which hereinafter will be referred to simply as image forming apparatus), the peripheral surface of the photoconductive drum uniformly charged by the charging means is selectively exposed at numerous points. As a result, a latent image is formed on the peripheral surface of the photoconductive drum. The latent image is visualized with the developer (toner) supplied by the developing means. Then, the visualized image, that is, the image formed of developer, is transferred onto recording medium. Then, the developer image on the recording medium is fixed to the recording medium with the application of heat and pressure to make the developer image permanent. Meanwhile, the developer remaining on the photoconductive drum after the transfer of the developer image is removed by a cleaning means, for example, a cleaning blade, and is stored, as residual developer (removed toner), in the cleaning means container. Thus, the development process for the following stage of an electrophotographic image forming operation can be carried out without the presence of the residual developer on the peripheral surface of the photoconductive drum.

As the cumulative usage of an electrophotographic image forming apparatus reaches a predetermined value, it becomes necessary to replace the photoconductive drum, replenish the apparatus with a fresh supply of developer, and/or replace the developer, and also, it becomes necessary to adjust, clean, or replace the components (charging device, cleaning means container, etc.), other than the photoconductive drum.

Thus, an electrophotographic image forming apparatus using an electrophotographic image forming process employs a process cartridge system, according to which an electrophotographic photoconductive member, and a single or plurality of processing means which act on the electrophotographic photographic member, are integrally disposed in a cartridge removably mountable in the main assembly of an electrophotographic image forming apparatus. A process cartridge system enables a user to maintain an electrophotographic image forming apparatus by him/her self, that is, without relying on service personnel, drastically improving operational efficiency. Thus, a process cartridge system has been widely used in the field of an electrophotographic image forming apparatus.

In an electrophotographic image forming apparatus such as the above described one, the following method is employed as a means for making it easier to maintain the main assembly of an electrophotographic image forming apparatus, and a process cartridge.

A process cartridge is provided with an internal storage element (storage means), and maintenance service information is stored in this internal storage element.

As a process cartridge is mounted into the image forming apparatus main assembly, the connector on the image forming apparatus main assembly side is connected to the connector on the process cartridge side.

The information in the storage element is taken in by the image forming apparatus main assembly through the connectors.

Based on the information taken in from the storage element in the process cartridge, the image forming apparatus main assembly determines whether or not the process cartridge therein is due for replacement, and displays the results of this determination.

In other words, the image forming apparatus main assembly is enabled to prompt, as necessary, a user to carry out a single or plurality of maintenance operations.

The employment of connectors for establishing electrical connection between the storage element in a process cartridge, and the image forming apparatus main assembly, makes it necessary to attach the connectors to the process cartridge, which in turn complicates the configuration of the process cartridge, tending to increase the process cartridge size.

The present invention is the result of the further development of the above described prior art.

SUMMARY OF THE INVENTION

The primary object of the present invention is to provide a process cartridge which has a single or plurality of memories, and which is no greater in size than a process cartridge having no memory, and also to provide an electrophotographic image forming apparatus in which such a process cartridge is removably mountable.

Another object of the present invention is to provide a combination of a process cartridge and an electrophotographic image forming apparatus, which assures that the information held by the memory of the process cartridge is reliably received by the main assembly of the image forming apparatus.

Another object of the present invention is to provide a combination of a process cartridge which is structured so that not only is it enabled to be accurately positioned relative to the main assembly of an electrophotographic image forming apparatus, but also, to accurately position its memory unit relative to the main assembly of the image forming apparatus, and an electrophotographic image forming apparatus in which such a process cartridge is removably mountable.

Another object of the present invention is to provide a combination of a process cartridge comprising: an electrophotographic photoconductive drum; and a single or plurality of processing means which act on the electrophotographic photoconductive drum; a memory which stores the information regarding the process cartridge and has an antenna for communicating with the main assembly of an electrophotographic image forming apparatus by way of the antenna on the main assembly side, wherein the memory of the process cartridge is attached to one end of the process cartridge in terms of the axial direction of the photoconductive drum; when the process cartridge is properly situated in the main assembly of the image forming apparatus, the surface of the portion of the process cartridge, to which the memory is attached, is kept pressed by the pressure generating member with which the main assembly of the image forming apparatus is provided; the antenna on the main assembly side is attached to the pressure generating member of the main assembly; and when the process cartridge is properly situated in the main assembly of the image forming apparatus, the antenna of the memory of the process cartridge and the antenna on the main assembly side oppose each other while the pressure generating member presses on the end of the process cartridge, to which the memory is attached, and also, to provide an electrophotographic image forming apparatus in which such a process cartridge is removably mountable.

These and other objects, features, and advantages of the present invention will become more apparent upon consideration of the following description of the preferred embodiments of the present invention, taken in conjunction with the accompanying drawings.

Figure 1:
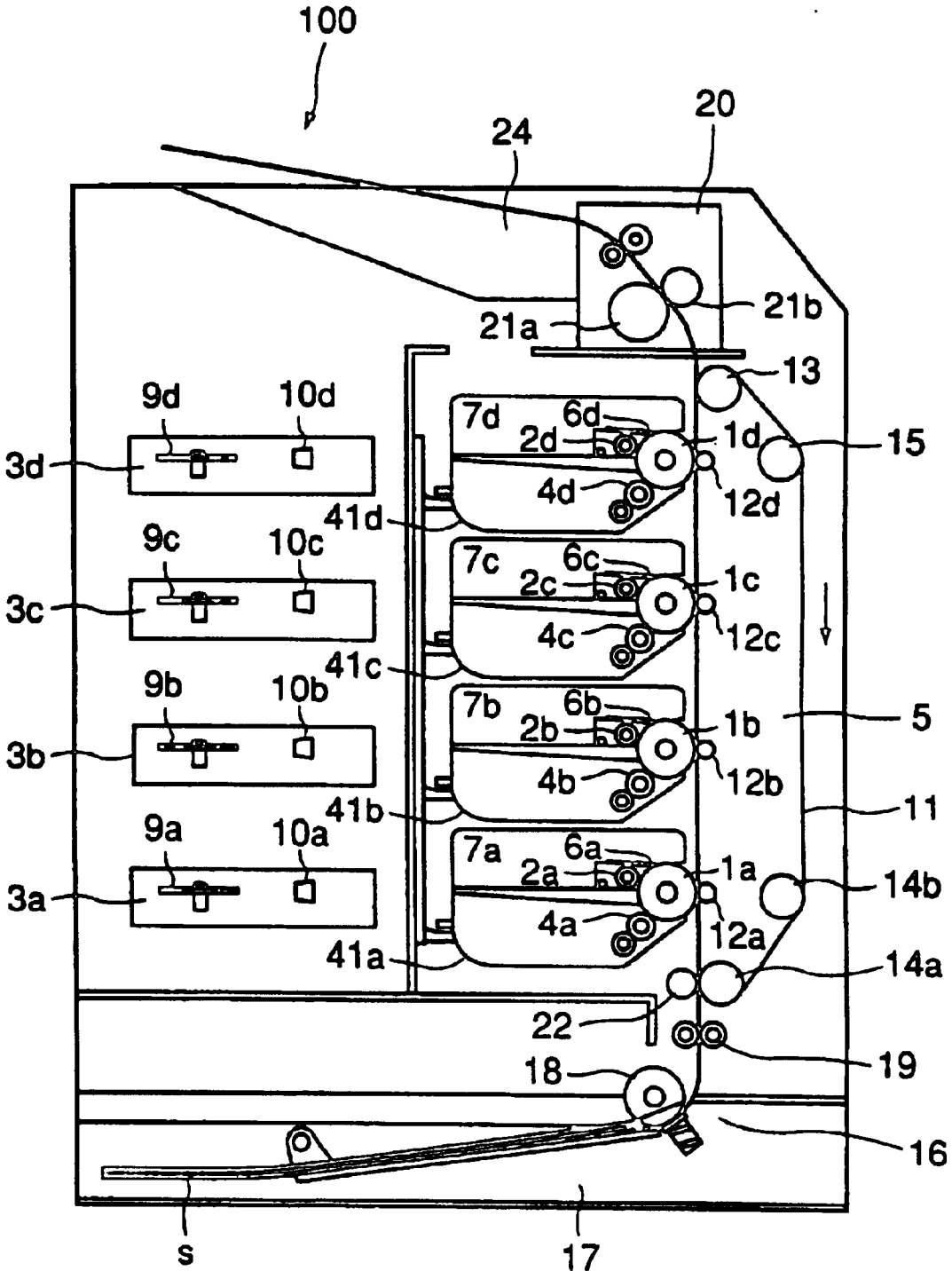
FIG. 1 is a vertical sectional view of the multicolor image forming apparatus in the first embodiment of the present invention.

DESCRIPTION OF THE PREFERRED EMBODIMENTS (Embodiment 1)

Hereinafter, the preferred embodiments of a multicolor image forming apparatus in accordance with the present invention will be described in more detail with reference to the appended drawings.

In the following descriptions, the lengthwise direction means the direction which is perpendicular to the direction in which recording medium is conveyed, and parallel to the surface of the recording medium. Regarding the alphanumeric references for the yellow, magenta, cyan, and black image forming portions, yellow, magenta, cyan, and black colors are represented by referential characters a, b, c, and k, respectively. Further, when any of the yellow, magenta, cyan, and black image forming portions, is referred to as an example of the image forming portions, or when all of them are referred to, the referential characters a, b, c, and d are not added to the numerical reference for the image forming portion; the image forming portion is referred to only by numerical references.

(General Structure of Multicolor Image Forming Apparatus)

First, the general structure of the multicolor image forming apparatus will be roughly described with reference to FIG. 1, which is a sectional view of a full-color laser beam printer as an example of an embodiment of a multicolor image forming apparatus in accordance with the present invention.

The main assembly 100 (which hereinafter may be referred to as apparatus main assembly) of the multicolor image forming apparatus in FIG. 1 comprises four electrophotographic photoconductive drums 1*a*, 1*b*, 1*c*, and 1*d* (which hereinafter will be referred to as photoconductive drums). The photoconductive drum 1 is rotationally driven by a driving means (unshown) in the counterclockwise direction of the drawing. In the adjacencies of the peripheral surface of the photoconductive drum 1, a charging apparatus 2 (2*a*, 2*b*, 2*c*, and 2*d*) as the primary charging means for uniformly charging the peripheral surface of the photoconductive drum 1, a scanner unit 3 (3*a*, 3*b*, 3*c*, and 3*d*) for forming an electrostatic latent image on the peripheral surface of the photoconductive drum 1 by scanning the peripheral surface of the photoconductive drum 1 with a beam of laser light modulated with image formation information, a developing apparatus 4 (4*a*, 4*b*, 4*c*, and 4*d*0 for developing the electrostatic latent image into a toner image, by adhering toner to the electrostatic latent image, an electrostatic transferring apparatus 5 for transferring the toner image on the photoconductive drum 1 onto a transfer medium S, that is, a recording medium, and a cleaning medium apparatus 6 (6*a*, 6*b*, 6*d*, and 6*d*) for removing the toner particles remaining on the peripheral surface of the photoconductive drum 1 after the toner image transfer, etc., are disposed in the mentioned order, in terms of the rotational direction of the photoconductive drum 1.

Figure 2:
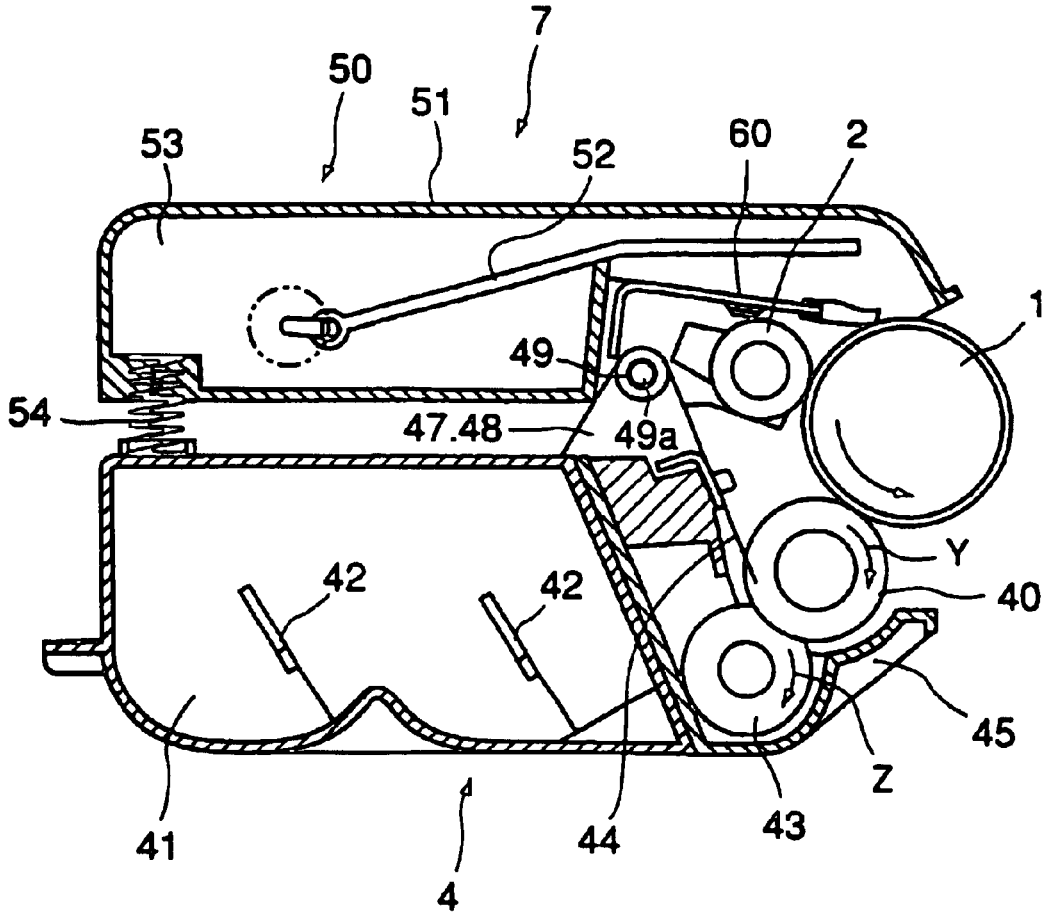
FIG. 2 is a vertical sectional view of the process cartridge in the first embodiment of the present invention.

The photoconductive drum 1, charging apparatus 2, developing apparatus 4, and cleaning apparatus 6 are integrally disposed in a cartridge, constituting the so-called process cartridge 7 (FIG. 2).

Next, the above mentioned components will be described in detail, starting from the photoconductive drum 1.

For example, the photoconductive drum 1 comprises an aluminum cylinder with a diameter of 30 mm, and a layer of photoconductor coated on the peripheral surface of the aluminum cylinder. The photoconductive drum 1 is rotationally supported by supporting members, by its lengthwise ends. It is rotationally driven in the counterclockwise direction by the driving force transmitted to one of its lengthwise ends from a motor (unshown) provided on the apparatus main assembly 100 side.

As for the charging method used by the charging apparatus 2, one of the contact charging methods may be used. The charging member of the charging apparatus 2 is an electrically conductive member in the form of a roller. As charge bias is applied to the charge roller while the charge roller is kept in contact with the peripheral surface of the photoconductive drum 1, the peripheral surface of the photoconductive drum 1 is uniformly charged. In this embodiment, or the first embodiment, one of the reversal developing methods is used. Therefore, the peripheral surface of the photoconductive drum 1 is charged to the negative polarity.

Referring to FIG. 1, the scanner unit 3 is disposed virtually level with the photoconductive drum 1. A beam of image formation light, that is, the light emitted by the laser diode (unshown) of the scanner unit 3 while being modulated with image formation signals, is projected onto the polygon mirror 9 (9*a*, 9*b*, 9*d*, and 9*d*), spun at a high velocity by the scanner motor (unshown). The image formation light deflected by the polygon mirror 9 is focused by the focusing lens 10 (10*a*, 10*b*, 10*c*, and 10*d*) on the charged peripheral surface of the photoconductive drum 1, selectively exposing numerous points on the peripheral surface of the photoconductive drum 1. Consequently, an electrostatic latent image is formed on the peripheral surface of the photoconductive drum 1.

Next, referring to FIG. 2, the developing apparatuses 4*a*, 4*b*, 4*c*, and 4*d* have toner containers 41*a*, 41*b*, 41*c*, and 41*d* containing yellow, magenta, cyan, and black toners, respectively. The toner in the toner container 41 is delivered by the toner delivery mechanism 42, to the toner supply roller 43 which is rotating in the clockwise direction indicated by an arrow mark (Z) in FIG. 2. The toner delivered to the toner supply roller 43 is coated onto the peripheral surface of the development roller 40, which is rotating in the clockwise direction indicated by an arrow mark (Y) in FIG. 2, by the toner supply roller 43 and the development blade 44 kept pressed upon the peripheral surface of the development roller 40. Thus, the toner is charged as it is coated onto the peripheral surface of the development roller 40.

As development bias is applied to the development roller 40 opposing the photoconductive drum 1 bearing a latent image, the toner on the peripheral surface of the development roller 40 is adhered to the peripheral surface of the photoconductive drum 1 in accordance with the pattern of the latent image; in other words, the latent image on the photoconductive drum 1 is developed into a toner image.

Referring again to FIG. 1, the electrostatic transferring apparatus 5 comprises an electrostatic conveying belt 11, which is circularly driven. The electrostatic conveying belt 11 is disposed in a manner to oppose all of the photoconductive drums 1*a*, 1*b*, 1*c*, and 1*d*, so that it remain in contact with all of the photoconductive drums 1*a*, 1*b*, 1*c*, and 1*d* as it is circularly driven. As the material for the electrostatic conveying belt 11, a film formed of a resinous substance, or a multilayer film comprising a substrate layer formed of a rubber and a layer of a resinous substance coated on the substrate layer, may be employed. The electrostatic conveying belt 11 is stretched around the driving roller 13, follower roller 14*a*, and tension roller 15. As it is circularly moved, it keeps the recording medium S electrostatically adhered to its outward surface, on the left-hand side, in terms of the loop it forms, in FIG. 1. As a result, the recording medium S is conveyed by the electrostatic conveying belt 11 to the transfer point, where the toner image on the photoconductive drum 1 is transferred onto the recording medium S.

The electrostatic transferring apparatus 5 also comprises four transfer rollers 12*a*, 12*b*, 12*c*, and 12*d*, which oppose the four photoconductive drums 1*a*, 1*b*, 1*c*, and 1*d*, respectively, being placed in parallel and in contact with the inward surface of the electrostatic conveying belt 11, in terms of the loop formed by the belt 11. To the transfer roller 12, bias positive in polarity is applied to give the recording medium S positive charge through the electrostatic transfer belt 11. As the bias positive in polarity is applied to the transfer roller 12, the toner image on the photoconductive drum 1, which is negative in polarity, is transferred onto the recording medium S by the electric field generated by the bias application.

Recording medium feeding/conveying portion 16 is for feeding the recording medium S into the apparatus main assembly and conveying it to the image forming portion. A cassette 17 stores a plurality of recording mediums S. During image formation, the feeding roller 18 (semicylindrical roller) and a registration roller pair 19 are rotationally driven in synchronism with the image formation, in order to separate the recording mediums S in the cassette 7 one by one, and to sequentially feed the recording mediums S into the apparatus main assembly and convey them to the transfer points. More specifically, as the leading edge of each recording medium S comes into contact with the registration roller pair 9, the recording medium S is temporarily prevented from advancing. As a result, the recording medium S slightly curves. Then, the recording medium S is released by the registration roller pair 9 in synchronism with the image formation, onto the electrostatic transfer belt 11 so that the arrival of the transfer starting line on the recording medium S at the transfer point (line) coincides with the arrival of the leading end (line) of the toner image on the photoconductive drum 1 at the transfer point (line).

The fixing portion 20 is for fixing to the recording medium S a plurality of the unfixed toner images, different in color, which have been transferred onto the recording medium S. It has a fixation roller pair 21 for applying heat and pressure to the recording medium S. The fixing roller 21 comprises a rotational heat roller 21*a*, and a pressure roller 21*b* kept pressed upon the rotational roller 21*a* to apply heat and pressure to the recording medium S.

To describe the operation of the fixing portion 20, as the recording medium S, bearing the unfixed toner images which have been transferred from the photoconductive drum 1, is passed through the fixing portion 20 by the fixation roller pair 21, heat and pressure is applied to the recording medium S by the fixation roller pair 21. As a result, the plurality of unfixed toner images different in color are fixed to the surface of the recording medium S.

As for the image forming operation, the process cartridges 7*a*, 7*b*, 7*c*, and 7*d* are sequentially driven in synchronism with the printing timing, and the photoconductive drums 1*a*, 1*b*, 1*c*, and 1*d* are rotationally driven in the counterclockwise direction in synchronism with the timing with which the process cartridges 7*a*, 7*b*, 7*c*, and 7*d* are driven. Also, the scanner units 3*a*, 3*b*, 3*c*, and 3*d* in the process cartridges 7*a*, 7*b*, 7*c*, and 7*d* are sequentially driven in synchronism with the rotations of the photoconductive drums 1*a*, 1*b*, 1*c*, and 1*d*, respectively. As the photoconductive drum 1 is rotationally driven, the peripheral surface of the photoconductive drum 1 is uniformly charged by the charge roller 2, and is exposed to the beam of light projected by the scanner unit 3 while being modulated with the image formation signals. The development roller 40 in the developing apparatus 4 transfers the toner therein onto the points of the electrostatic latent image, which are lower in potential level. As a result, a visible image is formed of toner, on the peripheral surface of the photoconductive drum 1; the electrostatic latent image is developed into a toner image.

The rotation of the registration roller pair 19 is started to release each recording medium S onto the electrostatic transfer belt 11 so that, as the electrostatic transfer belt 11 is circularly driven, the leading edge of the toner image on the peripheral surface of the photoconductive drum 1*a*, that is, the most upstream photoconductive drum 1 in terms of the recording medium conveyance direction, and the predetermined transfer starting line of the recording medium S, arrive, at the same time, at a predetermined point (line) in the contact area between the photoconductive drum 1*a* and electrostatic transfer belt 11.

Arriving at the contact area between the electrostatic adhesion roller 22 and electrostatic transfer belt 11, the recording medium S is nipped between the electrostatic adhesion roller 22 and electrostatic transfer belt 11, being thereby pressed upon the electrostatic transfer belt 11. Further, voltage is applied between the electrostatic transfer belt 11 and electrostatic adhesion roller 22, inducing thereby electrical charge in the recording medium S, which is dielectric, and the dielectric layer of the electrostatic transfer belt 11. As a result, the recording medium S is electrostatically adhered to the outward surface of the electrostatic transfer belt 11, and is conveyed by the electrostatic transfer belt 11 up to the most downstream transfer portion, remaining reliably adhered to the electrostatic transfer belt 11. The electrostatic adhesion roller 22 opposes the follower roller 14*a* with the interposition of the electrostatic transfer belt 11.

While the recording medium S is conveyed in the manner described above, the toner image on the photoconductive drum 1*a*, toner image on the photoconductive drum 1*b*, toner image on the photoconductive drum 1*c*, and toner image on the photoconductive drum 1*d*, are sequentially transferred onto the recording medium S by the electric fields generated between the photoconductive drums 1*a*, 1*b*, 1*c*, and 1*d*, and the transfer rollers 12*a*, 12*b*, 12*c*, and 12*d*, respectively.

After the transfer of the four toner images different in color onto the recording medium S, the recording medium S is separated from the electrostatic transfer belt 11 due to the curvature of the belt driving roller 13, and is conveyed into the fixing portion 20, in which the four toner images are thermally fixed to the recording medium S. Then, the recording medium S is discharged from the apparatus main assembly by the discharge roller pair 22, with its image bearing surface facing downward, through the print discharging portion 24.

Figure 3:
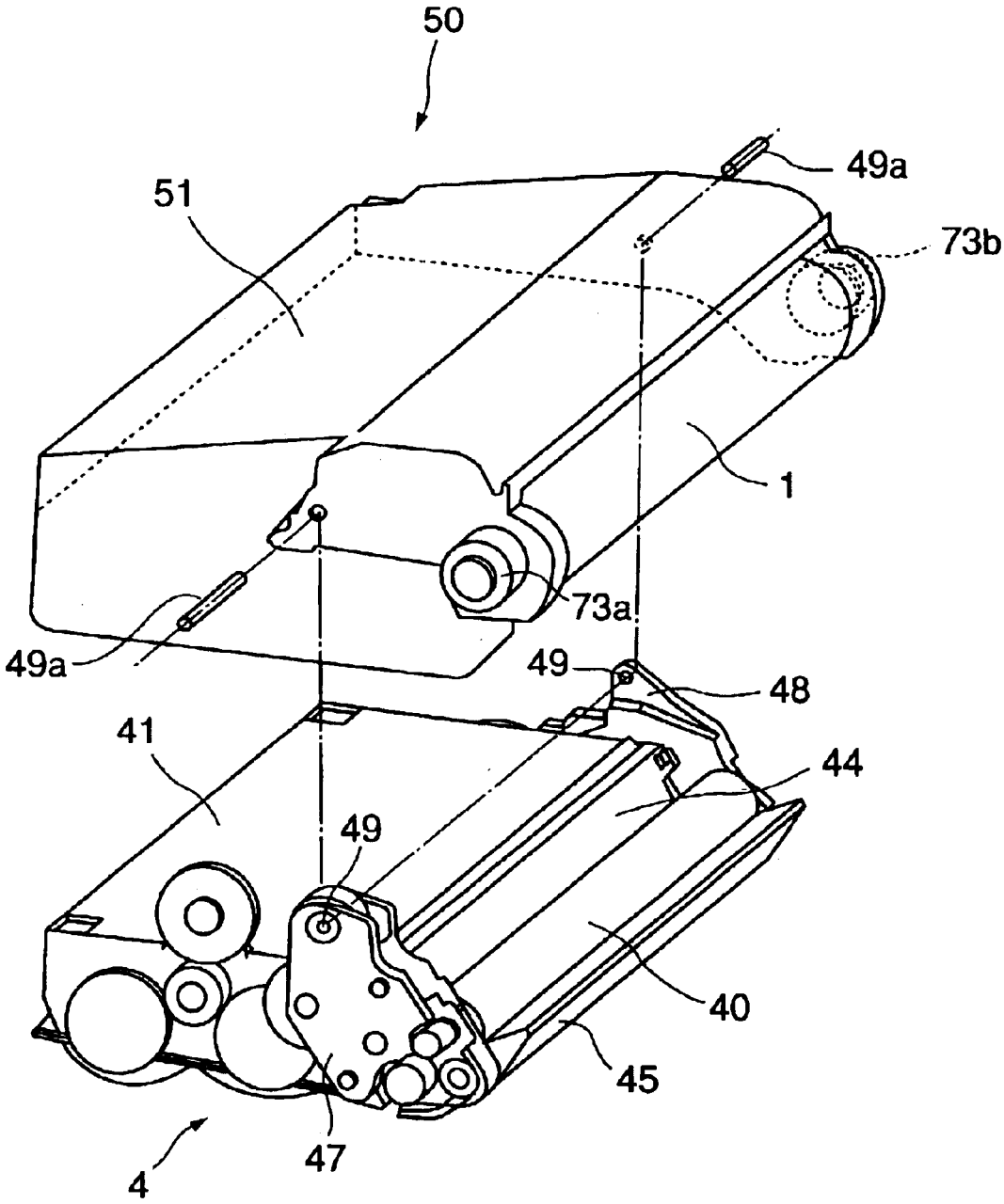
FIG. 3 is a perspective view of the cleaner unit frame and developing apparatus of the process cartridge in the first embodiment of the present invention.

Next, referring to FIGS. 2 and 3, the process cartridge 7 in accordance with the present invention will be described in detail. FIG. 2 is a sectional view of the process cartridge 7 at a plane perpendicular to the lengthwise direction of the photoconductive drum 1, and FIG. 2 is a perspective view of the process cartridge 7. The process cartridges 7*a*, 7*b*, 7*c*, and 7*d* for yellow, magenta, cyan, and black color components, respectively, are the same in structure.

The process cartridge 7 comprises a cleaner unit 50 and a development unit 4. The cleaner unit 50 comprises the photoconductive drum 1, primary charging means, and cleaning means, and the development unit 4 has the developing means for developing the electrostatic latent image on the photoconductive drum 1. The components of the developing apparatus 4 are unitized. Hence, the developing apparatus 4 is sometimes referred to as development unit 4.

The cleaner unit 50 also comprises a cleaner unit frame 51 as a part of the cartridge frame, to which the photoconductive drum 1 is rotationally attached with the interposition of the bearings 73*a* and 73*b*. Disposed in contact with the peripheral surface of the photoconductive drum 1 are the charging apparatus 2 as the primary charging means for uniformly charging the photoconductive layer, which is the outermost layer of the photoconductive drum 1, and the cleaning blade 60 for removing the developer (residual toner) remaining on the photoconductive drum 1 after the toner image transfer. After being removed from the peripheral surface of the photoconductive drum 1 by the cleaning blade 60, the residual toner (removed toner) is gradually sent by the toner sending mechanism 52 into the removed toner chamber 53 located in the rear portion of the cleaner unit frame 51.

The development unit 4 comprises the development roller 40, toner container 41, and development unit frame 45. The development roller 40 rotates in the direction indicated by the arrow mark Y, in contact with the photoconductive drum 1, and the toner container 41 stores the toner. The development roller 40 is rotationally supported by the development unit frame 45 with the interposition of bearings (unshown). The development unit 4 further comprises the toner supply roller 43 and development blade 44, which are disposed in contact with the peripheral surface of the development roller 40. The toner supply roller 43 rotates in the direction indicated by the arrow mark Z, in contact with the peripheral surface of the development roller 40. The toner container also contains a toner conveying mechanism 42 for conveying the toner in the toner container to the toner supply roller 43 while stirring the toner.

The development unit 4 is provided with a pair of arms attached to the lengthwise ends of the development unit 4, one for one, and the pair of arms are provided with bearings 47 and 48, one for one. The development unit 4 is connected to the cleaner unit 50, with a pair of development unit supporting pins 49*a* inserted in the holes 49 of the cleaner unit 50 and the bearing 47 and 48 of the development unit 4, being suspended from the cleaner unit 50 in such a manner that the entirety of the development unit 4 is enabled to pivot about the pair of pins 49*a*. The process cartridge 7 is provided with a pair of compression springs 54 disposed between the development unit 4 and cleaner unit 50 in such a manner that the development roller 40 is kept in contact with the photoconductive drum 1 by the resiliency of the compression springs 54.

During development, the toner in the toner container 41 is conveyed to the toner supply roller 43 by the toner stirring mechanism 42. As the toner is supplied to the toner supply roller 43, which is rotating in the arrow Z direction, the toner is supplied to the development roller 40; as the toner supply roller 43 rotating in the arrow Z direction rubs against the development roller 40 rotating in the arrow Y direction, the toner is borne onto the development roller 40 by being rubbed onto the development roller 40.

The toner borne on the development roller 40 is brought to the development blade by the rotation of the development roller 40. At the toner blade 44, the body of the toner on the development roller 40 is regulated in thickness, becoming a thin layer of toner, while being given a desired amount of electric charge. Then, as the development roller 40 rotates further, the thin layer of toner is conveyed to the development point, that is, the contact area between the photoconductive drum 1 and development roller 40, in which the toner particles in the thin layer of toner on the development roller 40 are adhered to the electrostatic latent image on the peripheral surface of the photoconductive drum 1 (electrostatic latent image is developed), by the development bias, that is, DC voltage applied to the development roller 40 from an unshown electric power source. As the development roller 40 is further rotated, the residual toner particles, that is, the toner particles which remained on the peripheral surface of the development roller 40 without contributing to the development of the electrostatic latent image, are moved back into the developing device, in which the residual toner particles are stripped from the peripheral surface of the development roller 40 by the toner supply roller 43 as the toner supply roller 43 rubs against the peripheral surface of the development roller 40; in other words, the residual toner particles are recovered. The recovered residual toner particles are mixed into the toner in the developing device by the toner stirring mechanism 42 as the recovered residual toner particles and the toner in the developing device are stirred together by the toner stirring mechanism 42.

In the case of a contact developing method, which is a development method in which the photoconductive drum 1 is placed in contact with the development roller 40, the photoconductive drum 1 is desired to be rigid, whereas the surface layer (portion which makes contact with photoconductive drum 1) of the development roller 40 is desired to be elastic. As the material for this elastic surface layer of the development roller 40, solid rubber or the like is used. In consideration of the fact that the surface layer of the development roller 40 is required to give the toner a satisfactory amount of electric charge, the surface of the layer formed of solid rubber or the like may be coated with resin.

Described next will be how the process cartridge 7 is accurately positioned relative to the apparatus main assembly 100 as the process cartridge 7 is mounted into the apparatus main assembly 100.

Figure 4:
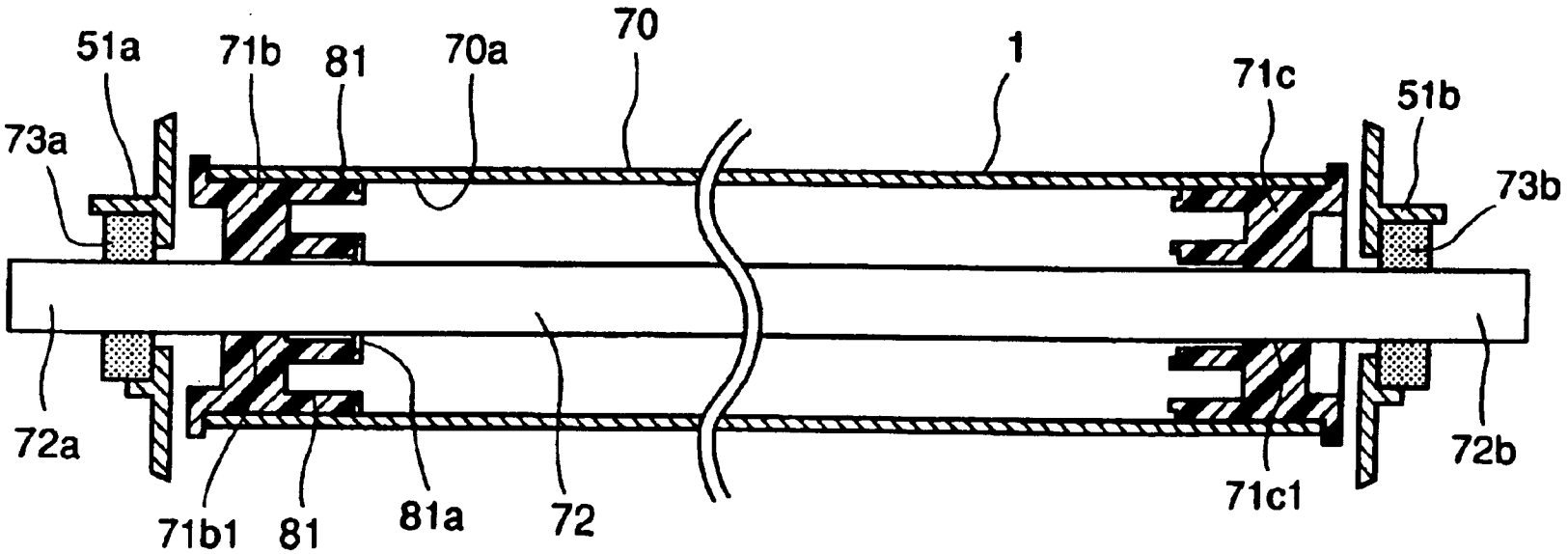
FIG. 4 is a sectional view of the photoconductive drum in the first embodiment of the present invention.

First, referring to FIG. 4, the structure of the process cartridge 7 will be described.

The photoconductive drum 1 comprises: a cylindrical member 70, the peripheral surface of which is coated with a layer of photoconductor; a pair of flanges 71*b* and 71*c*, which are formed of a resinous substance, and are fitted in the lengthwise ends (axial direction) of the cylindrical member 70, one for one; and a contact 81 solidly fixed to the flange 71*b* or both the flanges 71*b* and 71*c*, and placed in contact with the internal surface 70*a* of the cylindrical member 70. These components of the photoconductive drum 1 are unitized as the photoconductive drum 1. The resinous flanges 71*b* and 71*c* are provided with through holes 71 *b*1 and 71*c*1, the axial lines of which coincide with the axial line of the cylindrical member 70, and in which the electrically conductive shaft 72 is fitted.

The electrically conductive shaft 72 is in contact with the contact 81 at a contact point 81*a*, establishing electrical contact between the cylindrical member 70 and electrically conductive shaft 72. The electrically conductive shaft 72 extends outward from both of the lengthwise ends of the photoconductive drum 1, constituting the extensions 72*a* and 72*b*, by which the photoconductive drum 1 is rotationally supported by the bearings 73*a* and 73*b* which rotationally support the electrically conductive shaft 72. The bearings 73*a* and 73*b* are solidly fixed to the bearing supporting portions 51*a* and 51*b* of the cleaner unit frame 51. Thus, the photoconductive drum 1 is accurately positioned relative to the cleaner unit frame 51 with the interposition of the bearings 73*a* and 73*b*.

Next, the positioning of the process cartridge 7 and photoconductive drum 1 relative to the apparatus main assembly 100 will be described. First, referring to FIGS. 5, 6, and 9, the positioning of the photoconductive drum 1 will be described. The bearings 73*a* and 73*b* are attached to the left and right metallic side plates 74 and 75, respectively, (which correspond one for one to ends of axial line of photoconductive drum) of the apparatus main assembly 100, being positioned so that their peripheral surfaces are in contact with the left and right side plates 74 and 75. The left and right side plates 74 are provided with bearing positioning surfaces 74*a* and 74*b*, and right side plate 75 is provided with bearing positioning surfaces 75*a* and 75*b*. The peripheral surfaces of the bearings 73*a* and 73*b* are kept pressed against the bearing positioning surfaces 74*a* and 74*b*, and the bearing positioning surfaces 75*a* and 75*b*, respectively, whereby the photoconductive drum 1 is accurately positioned relative to the left and right side plates 74 and 75 with the interposition of the bearing 73*a* and 73*b*, respectively. Further, for the positioning of the photoconductive drum 1, the photoconductive drum 1 is kept pressed on the left and right side plates 74 and 75.

Figure 6:
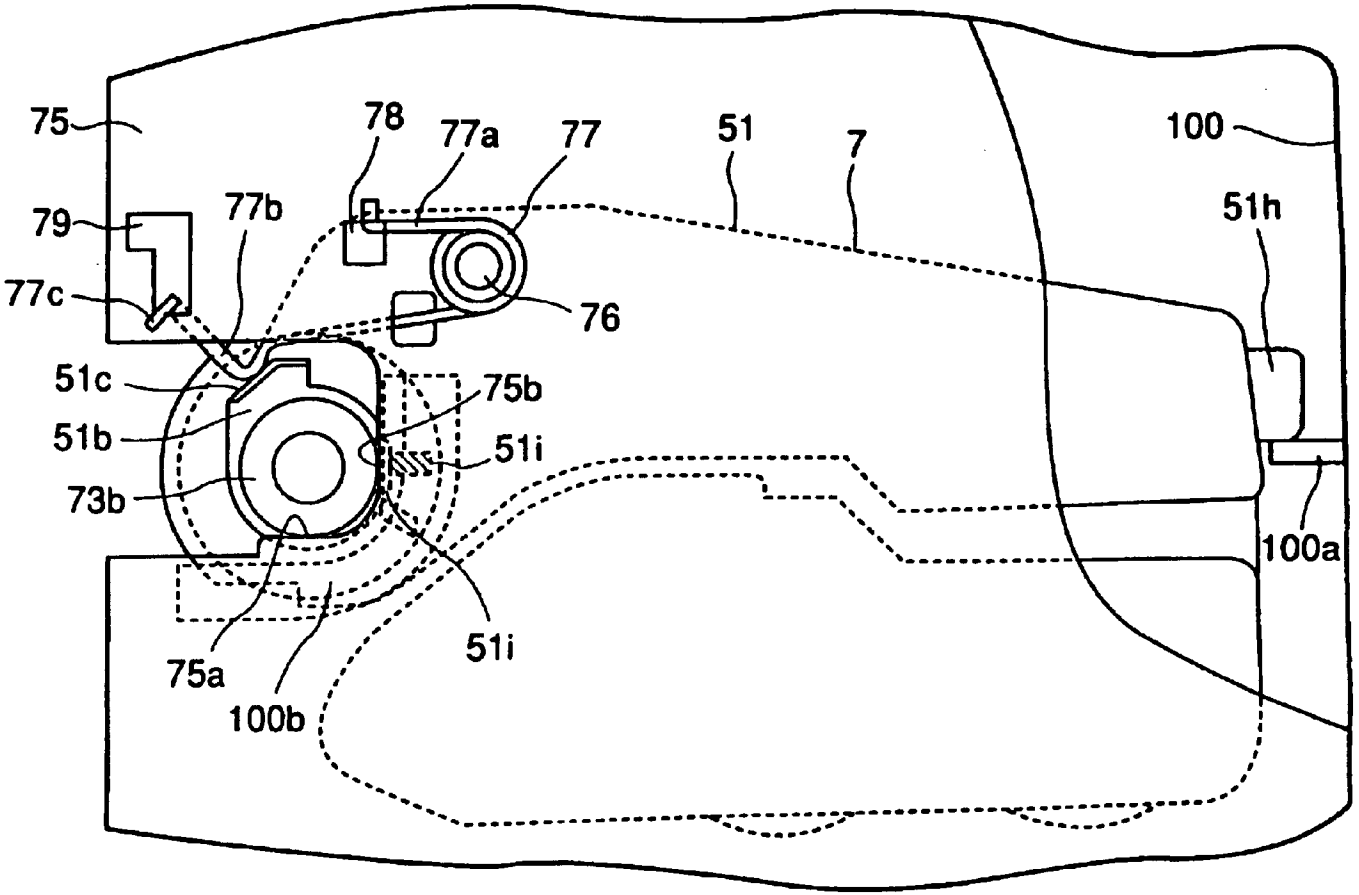
FIG. 6 is a right side view of the process cartridge mounting portion of the multicolor image forming apparatus in the first embodiment of the present invention.
Figure 7:
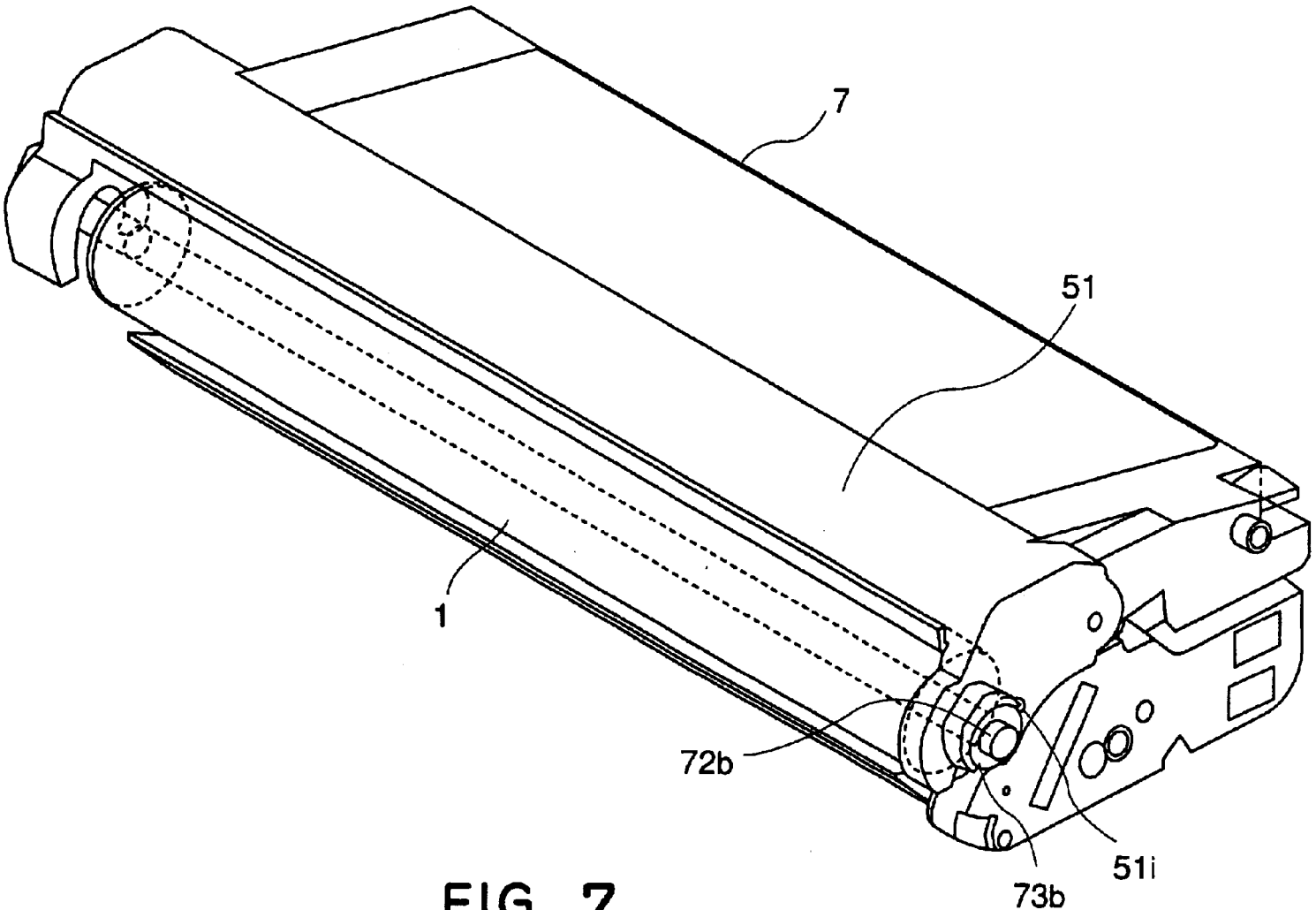
FIG. 7 is a perspective view of the process cartridge in the first embodiment of the present invention, for showing the front, right, and top sides of the process cartridge.

Next, the method for keeping the photoconductive drum 1 pressed upon the left and right side plate 74 and 75 will be described. Herein, the method will be described in detail regarding only one (right side plate 75) of the lengthwise ends of the photoconductive drum 1. The method regarding the other end is the same as the method which will be described next. Referring to FIG. 6, except for the portions of the peripheral surface of the bearing 73*b*, by which the bearing 73*b* is in contact with the bearing positioning surfaces 75*a* and 75*b* of the right side plate 75, the peripheral surface of the bearing 73*b* is covered with the bearing supporting portion 51*b*, that is, a part of the cleaner unit frame 51, for supporting the bearing 73*b*.

In comparison, the right side plate 75 is provided with a metallic shaft 76, which is attached to the right side plate 75 by crimping. The shaft 76 supports a helical torsion spring 77, which is kept wound in a manner to make the arm portions 77*a* and 77*b* of the helical torsion spring 77 come closer to each other so that force is generated by the resiliency of the spring 77 in the direction to move the two arm portions 77*a* and 77*b* away from each other. One of the arm portions 77*a*, that is, one end of the piece of springy wire constituting the helical torsion spring 77, is solidly attached to the right side plate 75 by being fitted in the hole 78 of the right side plate 75, whereas the arm portion 77*b*, or the other end of the piece of springy wire constituting the helical torsion spring, is rested on the edge of the hole 79 of the right side plate 75, with the bent portion 77*c* of the arm portion 77*b* hitched to the edge of the hole 79, being prevented from moving in the direction to unwind the helical torsion spring 77 when the process cartridge 7 is out of the apparatus main assembly 100. When the process cartridge 7 is in the apparatus main assembly 100, the arm portion 77*b*, or the other end of the helical torsion spring 77, is kept pressed upon the spring pressure bearing portion 51*c* of the cleaner unit frame 51. As a result, the bearing 73*b* is pressed upon the bearing positioning surfaces 75*a* and 75*b* by the resiliency of the helical torsion spring 77, accurately positioning the process cartridge 7 and photoconductive drum 1 relative to the right side plate 75.

Figure 5:
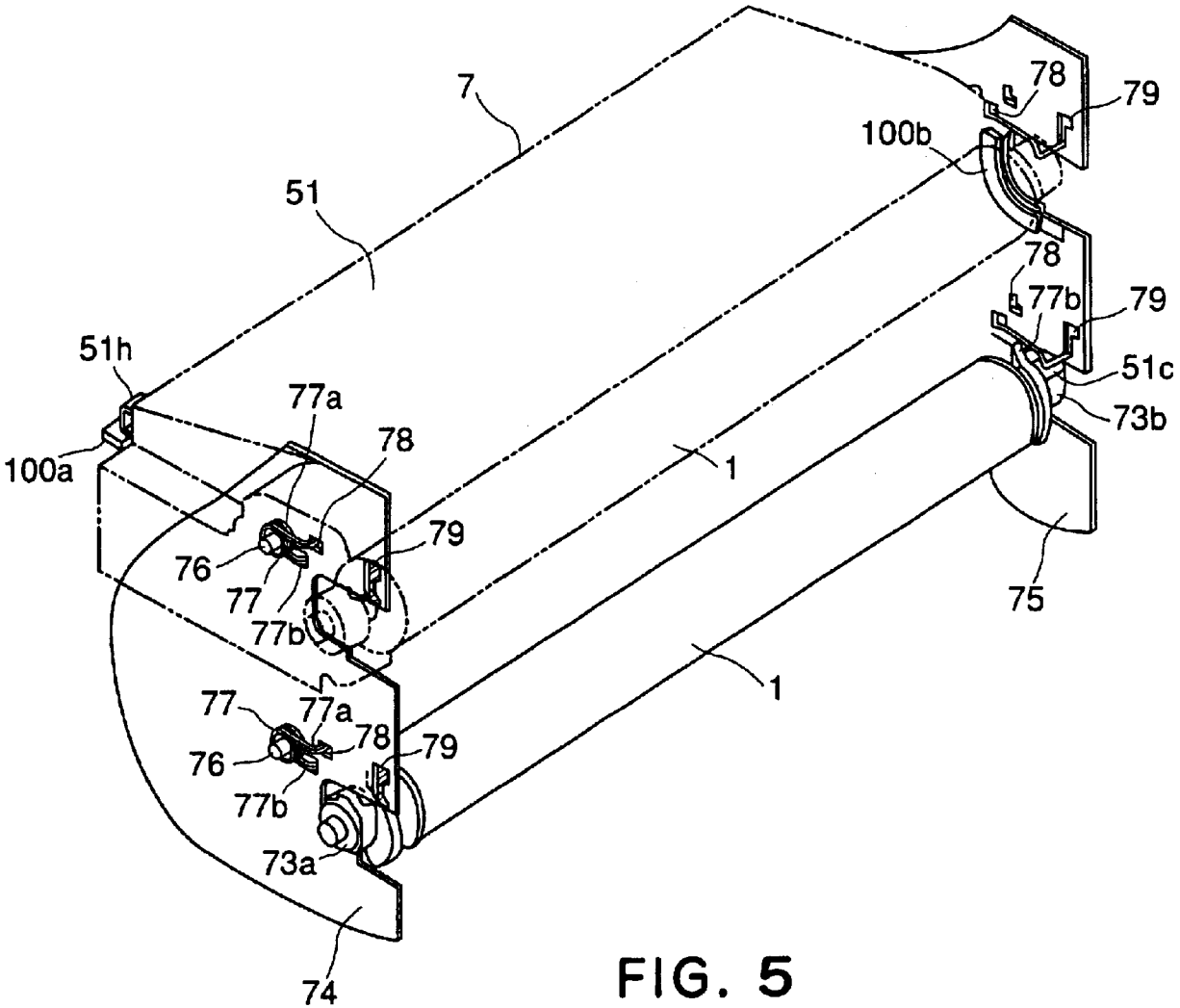
FIG. 5 is a perspective view of the process cartridge mounting portion of a multicolor image forming apparatus.
Figure 8:
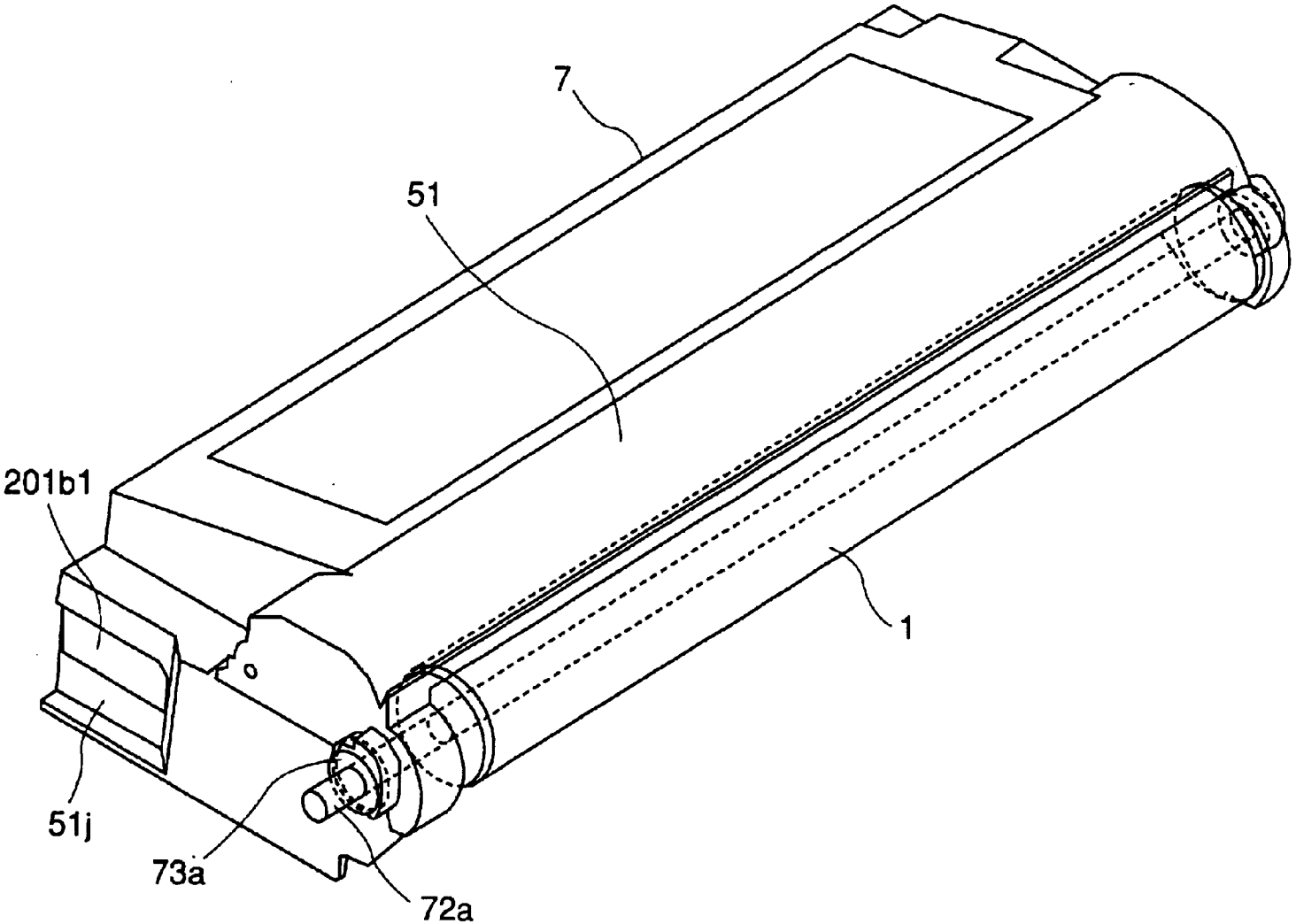
FIG. 8 is a perspective view of the process cartridge in the first embodiment of the present invention, for showing the front, left, and top sides of the process cartridge.

Next, referring to FIGS. 5, 6, and 8, the position of the axial line of the photoconductive drum 1 relative to the apparatus main assembly 100 in terms of the pivotal direction of the process cartridge 7 becomes fixed, and remains fixed, as the pivotal movement controlling portion 51*h* of the cleaner unit frame 51 comes into contact with the cartridge catching portion 100*a* extending into the cartridge mounting space of the apparatus main assembly 100 from the wall of the cartridge mounting space in the radius direction of the pivotal movement of the cartridge 7, due to the weight of the process cartridge 7.

Figure 10:
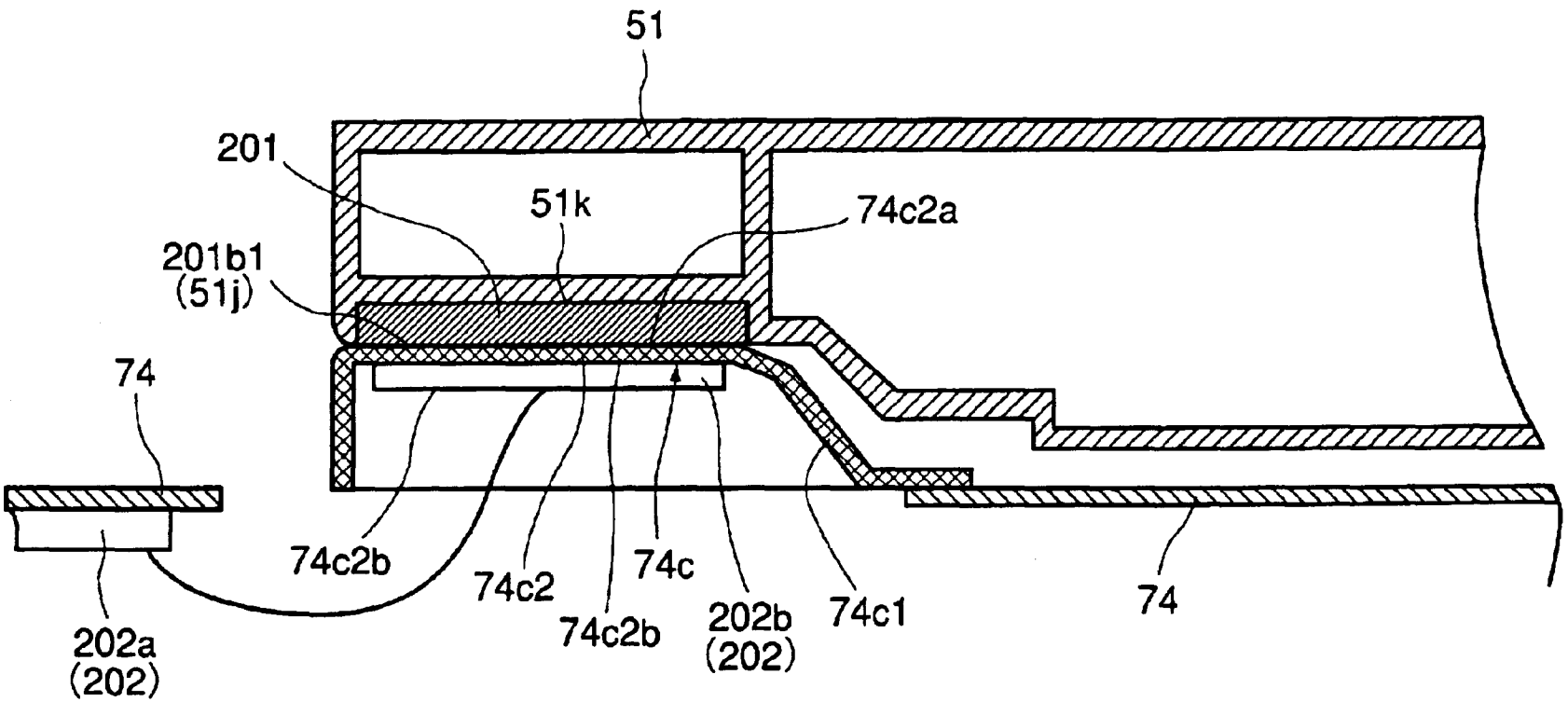
FIG. 10 is a horizontal sectional view of the process cartridge in the first embodiment of the present invention, for showing the thrust generating structure of the process cartridge.

Next, referring to FIGS. 8 and 10, the positioning of the process cartridge 7 in terms of its thrust direction (direction parallel to axial line of photoconductive drum 1) will be described. It is assumed that the position of the process cartridge 7 relative to the apparatus main assembly 100 in terms of the thrust direction of the process cartridge 7 is to be fixed with reference to the right side plate 75 of the apparatus main assembly 100. The left side plate 74 of the apparatus main assembly 100 is provided with a cartridge pressing member 74*c* (thrust generating means) as a means for keeping the process cartridge 7 pressured toward the right side plate 75 of the apparatus main assembly 100 in terms of the thrust direction of the process cartridge 7. As the process cartridge 7 is mounted into the apparatus main assembly 100, the thrust bearing portion 51*j* of the cleaner unit frame 51, shown in FIG. 8, comes into contact with the cartridge pressing member 74*c* (thrust generating member). As the process cartridge 7 is further inserted into the apparatus main assembly 100, thrust bearing portion 51*j* is pressured by the thrust generated by resiliency of the cartridge pressing member 74*c* (thrust generating member) of the apparatus main assembly 100. As a result, the butting portion 51*i* of the cleaner unit frame 51, which is a part of the surface of the cleaner unit 51, is butted against the cartridge thrust bearing portion 100*b* of the apparatus main assembly 100, accurately fixing the position of the process cartridge 7 relative to the apparatus main assembly 100 in terms of the thrust direction.

Figure 9:
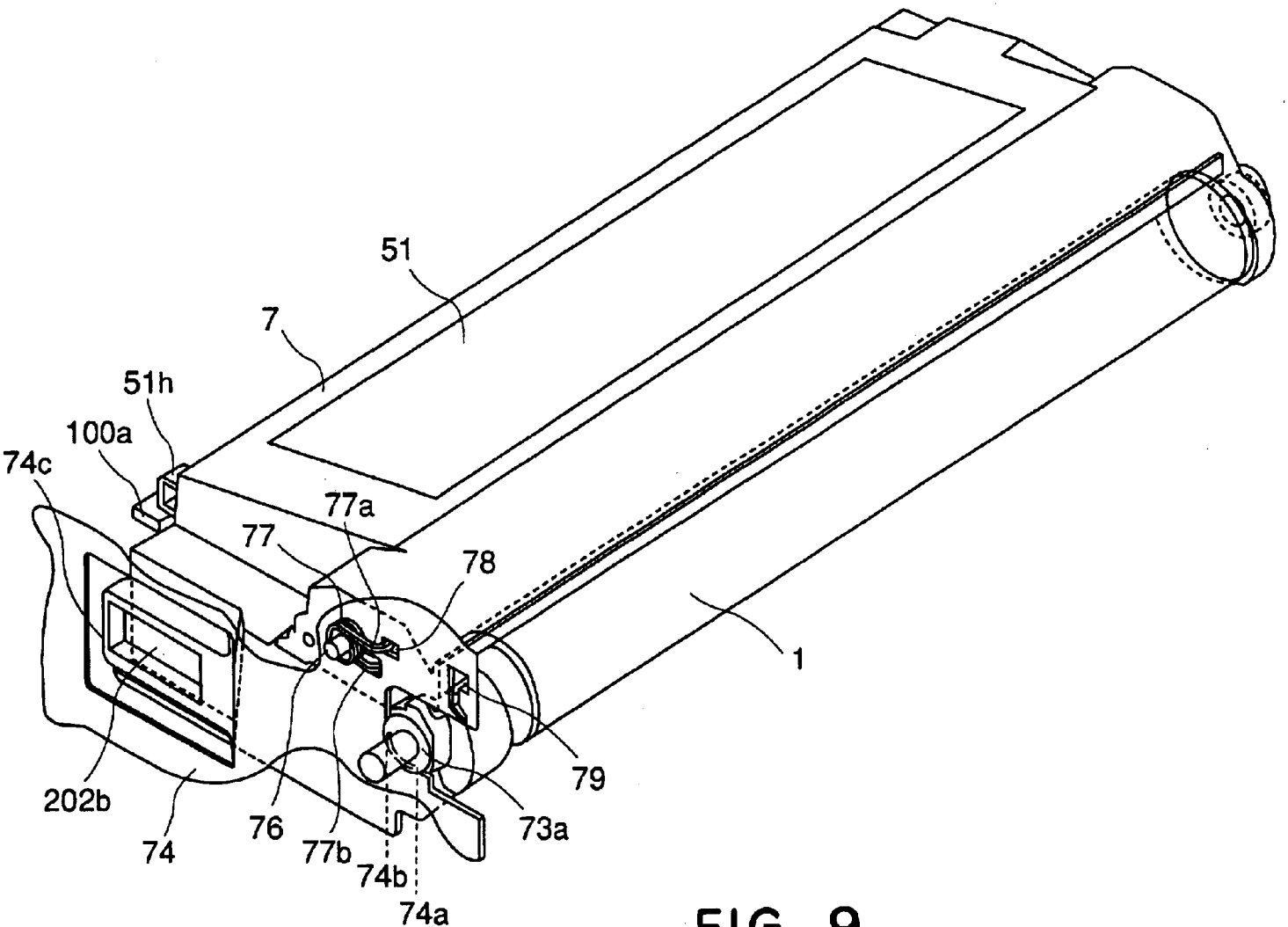
FIG. 9 is a perspective view of the left side of the process cartridge mounting portion of the multicolor image forming apparatus in the first embodiment of the present invention.

The cartridge pressing member 74*c* (thrust generating member) is formed of a resinous substance, and comprises the springy portion 74*c*1 and actual pressing portion 74*c*2. It is fixed to the left side plate 74 by the end of the springy portion 74*c*1. Further, the process cartridge 7 and apparatus main assembly 100 are structured so that when the process cartridge 7 is properly mounted in the apparatus main assembly 100, the actual pressing portion 74*c*2 and thrust bearing portion 51*j* oppose each other, with the springy portion 74*c*1 remaining resiliently bent. Therefore, when the process cartridge 7 is properly mounted in the apparatus main assembly 100, the cleaner unit frame 51, hence, the process cartridge 7, is kept pressured toward the right side plate 75 by the thrust generated by the resiliency of the springy portion 74*c*1 (FIGS. 8 and 9).

When the process cartridge 7 is properly situated in the apparatus main assembly 100, it can be removed from the apparatus main assembly 100 by following in reverse the above described cartridge mounting steps. In other words, the process cartridge 7 and apparatus main assembly 100 are structured so that the former is removably mounted in the latter.

(Wireless Information Communication System)

Next, the wireless information communication system between the image forming apparatus main assembly 100 and process cartridge 7 will be described.

The process cartridge 7 is provided with a magnetic core, which is used as the communication antenna of the wireless communication system in this embodiment. Further, the apparatus main assembly 100 is provided with an inductor, which is used as the communication antenna. When the process cartridge 7 is in the apparatus main assembly 100, the information communication between the process cartridge 7 and apparatus main assembly 100 is wirelessly carried out by electromagnetic induction through the magnetic core. In other words, in this embodiment, the information is transmitted between the apparatus main assembly 100 and process cartridge 7 by way of their antennas with the use of electromagnetic energy. Therefore, the mechanical connectors for transmitting information between the apparatus main assembly 100 and process cartridge 7 are unnecessary. In other words, the employment of the wireless communication system can eliminate problems such as that the provision of the above described mechanical connectors results in the increase in the process cartridge size, and also, that the communication between the apparatus main assembly 100 and process cartridge 7 fails due to the unsatisfactory mechanical connection between the apparatus main assembly 100 and process cartridge 7.

Next, referring to FIGS. 8–12, the structure of the wireless information communication system in this embodiment will be described. Referring to FIG. 10, the process cartridge 7 is provided with a memory unit 201 as an information storing means, whereas the apparatus main assembly 100 is provided with a communication unit 202 as a communicating means. Further, there is provided a noncontact communication mechanism between the memory unit 201 and the antenna unit 202*b* of the communication unit 202.

In other words, the antenna 201*a*2 of the memory unit 201 and the antenna unit 202*b* exchange information through radio communication; they do not contact each other.

Herein, the information storing means is configured as follows:

The information storing means has a storage element for storing information, and the information stored in the storage element is transmitted to the image forming apparatus main assembly by way of the antennas.

The information storing means does not make electrical contact with the image forming apparatus main assembly.

The information transmission between the information storing means and image forming apparatus main assembly is wirelessly carried out.

The communication unit 202 comprises at least a communication control unit 202*a* fixed to the apparatus main assembly 100, and the antenna unit 202*b*, as the antenna on the apparatus main assembly side, connected to the communication unit 202*a*. The antenna unit 202*b* is attached to the cartridge pressing member 74*c* (thrust generating member). To describe in more detail, the pressing portion 74*c*2 of the cartridge pressing member 74*c* (thrust generating member) has a cartridge facing surface 74*c*2*a* and an antenna unit facing surface 74*c*2*b*. The antenna unit 202*b* is kept pressed upon the antenna unit facing surface 74*c*2*b* by an unshown resilient pressure applying means.

Figure 11:
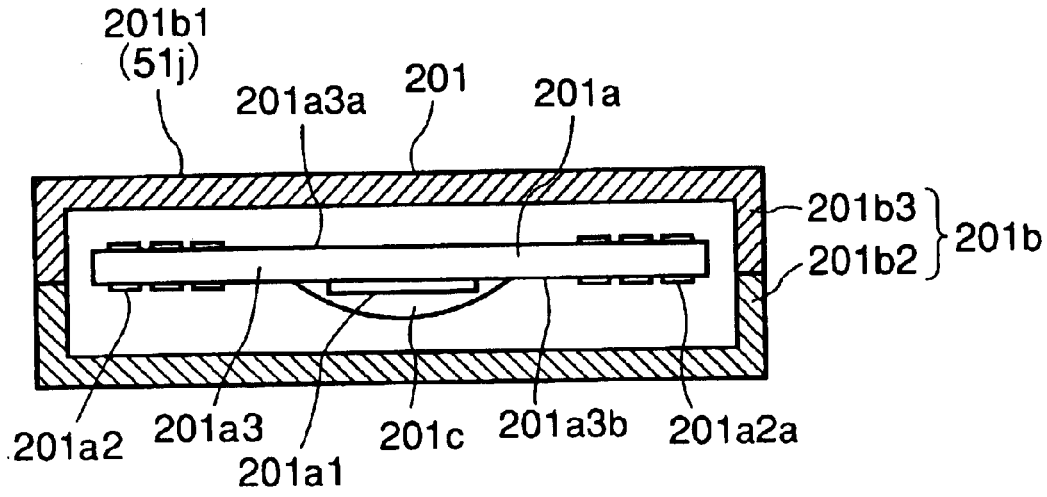
FIG. 11 is a vertical sectional view of a memory unit (memory).

The memory unit 201 comprises an actual memory unit 201*a* and a housing 201*b* covering the actual memory unit 201*a* (FIG. 11). The structures of the actual memory unit 201*a* and housing 201*b* will be described later in detail. The memory unit 201 is attached to the surface 51*k* of the cleaner unit frame 51 with the use of two-sided adhesive tape or the like so that it opposes the cartridge pressing member 74*c* (thrust generating member). With the provision of the above described structural arrangement, the apparatus main assembly facing surface 201*b*1 of the housing 201*b* of the memory unit 201 constitutes the thrust bearing portion 51*j* of the process cartridge 7.

The memory unit 201 as an information storing means is disposed on the surface 51*k* of the cleaner unit frame 51, which is intersectional to the axial line of the photoconductive drum 1.

Further, the intersectant surface 51*k* is the opposite surface of the apparatus main assembly facing surface 201*b*1 (51*j*), that is, the surface which is butted against the apparatus main assembly 100 to accurately position the process cartridge 7 relative to the apparatus main assembly 100 in terms of the axial direction of the photoconductive drum 1.

Further, the intersectant surface 51*k* is located so that it opposes the cartridge pressing member 74*c* (thrust generating member), which is the springy pressing means of the apparatus main assembly 100 for keeping the butting surface 201*b*1 (51*j*) of the process cartridge 74*c* butted against the apparatus main assembly 100 in order to keep the process cartridge 7 accurately positioned relative to the apparatus main assembly 100 in terms of the axial direction of the photoconductive drum 1.

As the process cartridge 7 is mounted into the apparatus main assembly 100, it is positioned relative to the apparatus main assembly 100 so that the memory unit 201 opposes the cartridge pressing member 74*c* (thrust generating member), and at the same time, the distance between the memory unit antenna 201*a*2 attached to the actual memory portion 201*a* of the memory unit 201, and the antenna unit 202*b*, is set to a predetermined value, by the housing 201*b* of the memory unit 201 and the actual pressing portion 74*c*2 of the cartridge pressing member 74*c* (thrust generating member). The memory unit antenna 202*b* will be described later.

Herein, the structure for pressing the process cartridge 7 for accurately positioning the process cartridge 7 relative to the apparatus main assembly 100 in terms of the axial direction (thrust direction) of the photoconductive drum 1 doubles as the structure for regulating the distance between the memory unit communication antenna 201*a*2 of the memory unit 201 of the process cartridge 7, and the antenna unit 202*b* of the apparatus main assembly 100.

Next, the structure of the memory unit 201 will be described.

Referring to FIG. 11, the memory unit 201 comprises the substrate unit 201*a* (actual memory portion), and the housing 201*b* covering the actual memory portion 201*a*. More specifically, the housing 201*b* covers the storage element, communicating members, and memory antenna. The actual memory portion 201*a* comprises the storage element 201*a*1 for storing information, the communication antenna 201*a*2 as the memory antenna, which is a magnetic core, and substrate 201*a*3, to which the storage element 201*a*1 and communication antenna 201*a*2 are integrally mounted; the storage element 201*a*1, communication antenna 201*a*2, and substrate 201*a*3 are unitized.

Figure 12:
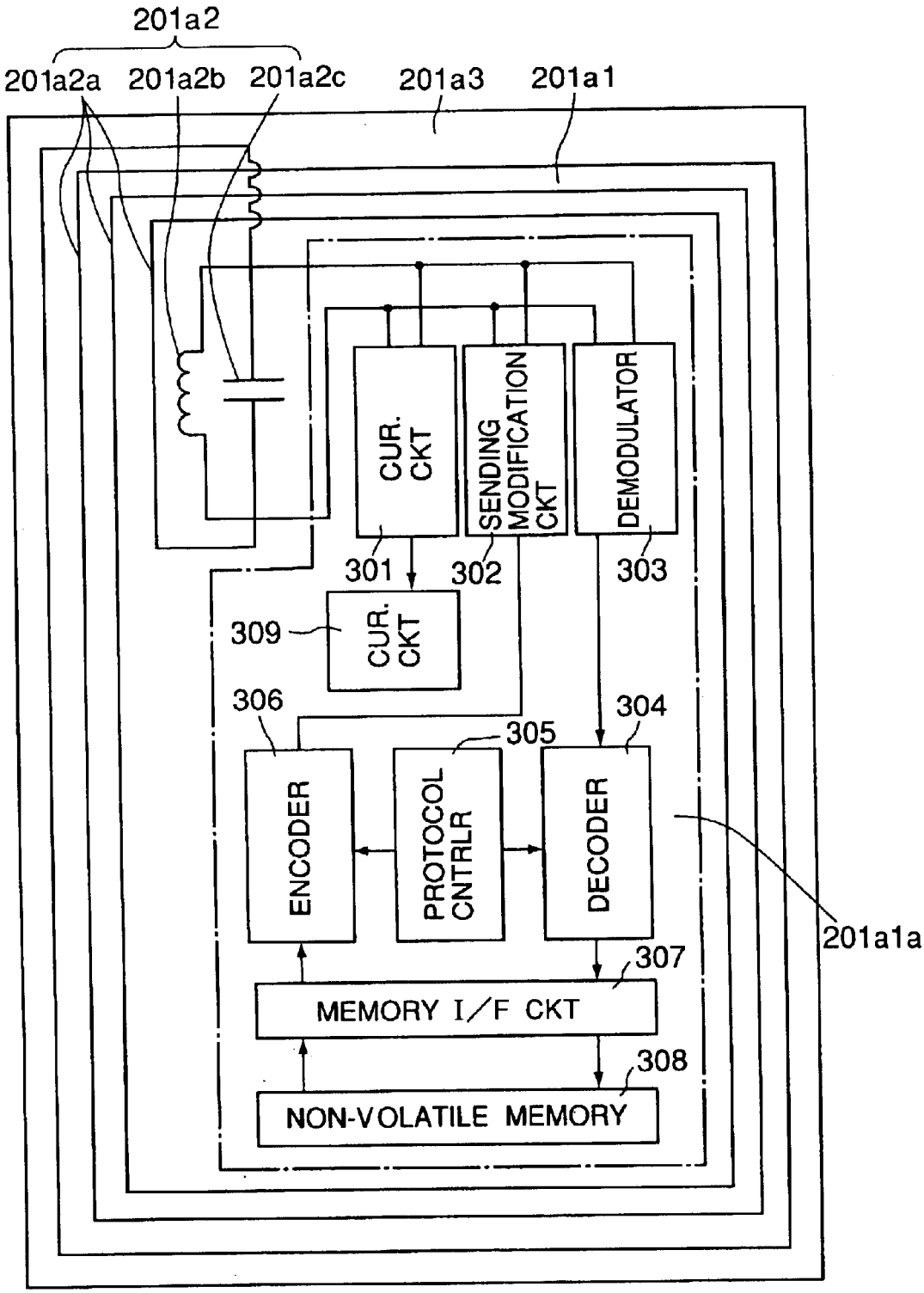
FIG. 12 is a diagram of the electric wiring of the memory communication antenna and storage element on the substrate of the process cartridge memory.

The memory unit communication antenna 201*a*2 has electrically conductive patterns 201*a*2*a*, which are on the front surface 201*a*3*a* (surface opposing antenna unit 202*b* of apparatus main assembly) and back surface 201*a*3*b* of the substrate 201*a*3. The electrically conductive pattern 201*a*2*a* is in the form of a quasi-volute, which conforms to the rectangular shape of the substrate 201*a*3 formed of epoxy, and is formed by printing. The memory unit communication antenna 201*a*2 is extended in the quasi-volute pattern 201*a*2*a*, on the front surface 201*a*3*a* of the substrate 201*a*3, extended through the substrate 201*a*3 onto the back surface 201*a*3*b* of the substrate 201*a*3, extended in the quasi-volute pattern 201*a*2*a*, on the back surface 201*a*3*b*, and extended back onto the front surface 201*a*3*a* through the substrate 201*a*3; in other words, the portion of the memory unit communication antenna 201*a*2 on the front surface 201*a*3*a* of the substrate 201*a*3, is electrically in connected to the portion of the memory unit communication antenna 201*a*2 on the back surface 201*a*3*b* of the substrate 201*a*3. Further, the ends of the memory unit communication antenna 201*a*2 in the form of the pattern 201*a*2*a* are electrically connected to the transmission circuit 201*a*1*a* of the storage element 201*a*1 (FIG. 12).

The storage element 201*a*1 is disposed approximately in the middle of the back surface 201*a*3*b* of the substrate 201*a*3, surrounded by the pattern 201*a*2*a*. It is protected by being covered with resinous bond 201*c*. The storage element 201*a*1 in this embodiment is a FeRAM. The information stored therein is concerned with the process cartridge 7; for example, the cumulative usage time of the photoconductive drum 1, cumulative charging time of the charging means, amount of the remaining developer, etc.

The memory housing 201*b* comprises an outward portion 201*b*3 having the apparatus main assembly facing surface 201*b*1, and an inward portion 201*b*2. The outward and inward portions 201*b*3 and 201*b*2 are joined by bonding, welding, or the like means, to create the memory housing 201*b* with an internal space in which the actual memory portion 201*a* can be inserted. The material for the memory housing 201*b* in this embodiment is such an antistatic substance that is physically strong enough to withstand the pressure applied by the aforementioned cartridge pressing member 74*c* (thrust generating member). More specifically, it is a noninductive member, the dielectric constant of which is in the range of 2–5. Herein, the dielectric constant means the value obtained using the ASTM testing method (D150). As for the material for the memory housing 201*b*, an optimum one may be selected from among polystyrene resin, acrylonitrile-butadiene resin, polycarbonate resin, etc.

Next, referring to FIG. 12, the internal structure of the storage element 201*a*1 will be described. FIG. 12 is a circuit diagram of the storage element, for describing the storage element 201*a*1. The storage element 201*a*1 is integral with the transmission circuit 201*a*1*a* as a transmitting member on the substrate 201*a*3, and the transmission circuit 201*a*1*a* transmits the information stored in the storage element 201*a*1 to the memory communication antenna (which hereinafter may sometimes be referred to as memory antenna). The memory communication antenna 201*a*2 comprises the conductive patterned portion 201*a*2*a*, a coil 201*a*2*b*, and a condenser 201*a*2*c*, and is connected to the rectification circuit 301, transmission modulation circuit 302, and demodulator 303 of the transmission circuit 201*a*1*a*. The storage element 201*a*1 also comprises: a decoder 304, a protocol controller 305, an encoder 306, a memory interface circuit 307, and a nonvolatile memory 308, such as a ferroelectric memory, an EEPROM, etc. The components between the memory 308 and memory antenna 201*a*2 make up the transmitting member for transmitting the information from the memory 308 to the memory antenna 201*a*2.

The output terminal of the rectification circuit 301 is connected to an electric power circuit 309 to supply the nonvolatile memory 308 with electric power. The high frequency waves received by the memory antenna 201*a*2 are demodulated by the demodulator 303 into baseband signals, which are converted by the decoder 304 being controlled by the protocol controller 305, into signals appropriate to be sent to the nonvolatile memory 308. Then, the signals are divided into addresses and data by the memory interface circuit 307, and are written into the nonvolatile memory 308 in response to write commands. The data in the nonvolatile memory 308 are read in response to read commands. After being read out of the nonvolatile memory 308, the data (signals) are sent through the memory interface circuit 307 to the encoder 306, in which the signals are converted into such signals that are in accordance with the protocol suitable for transmission. Then, the converted signals are sent to the memory communication antenna 201*a*2 through the transmission modulation circuit 302.

(Embodiment 2)

The members, portions, etc., in this embodiment, which are the duplicates of those in the first embodiment, will be given the same referential symbols as those given in the first embodiment, and will not be described.

Figure 13:
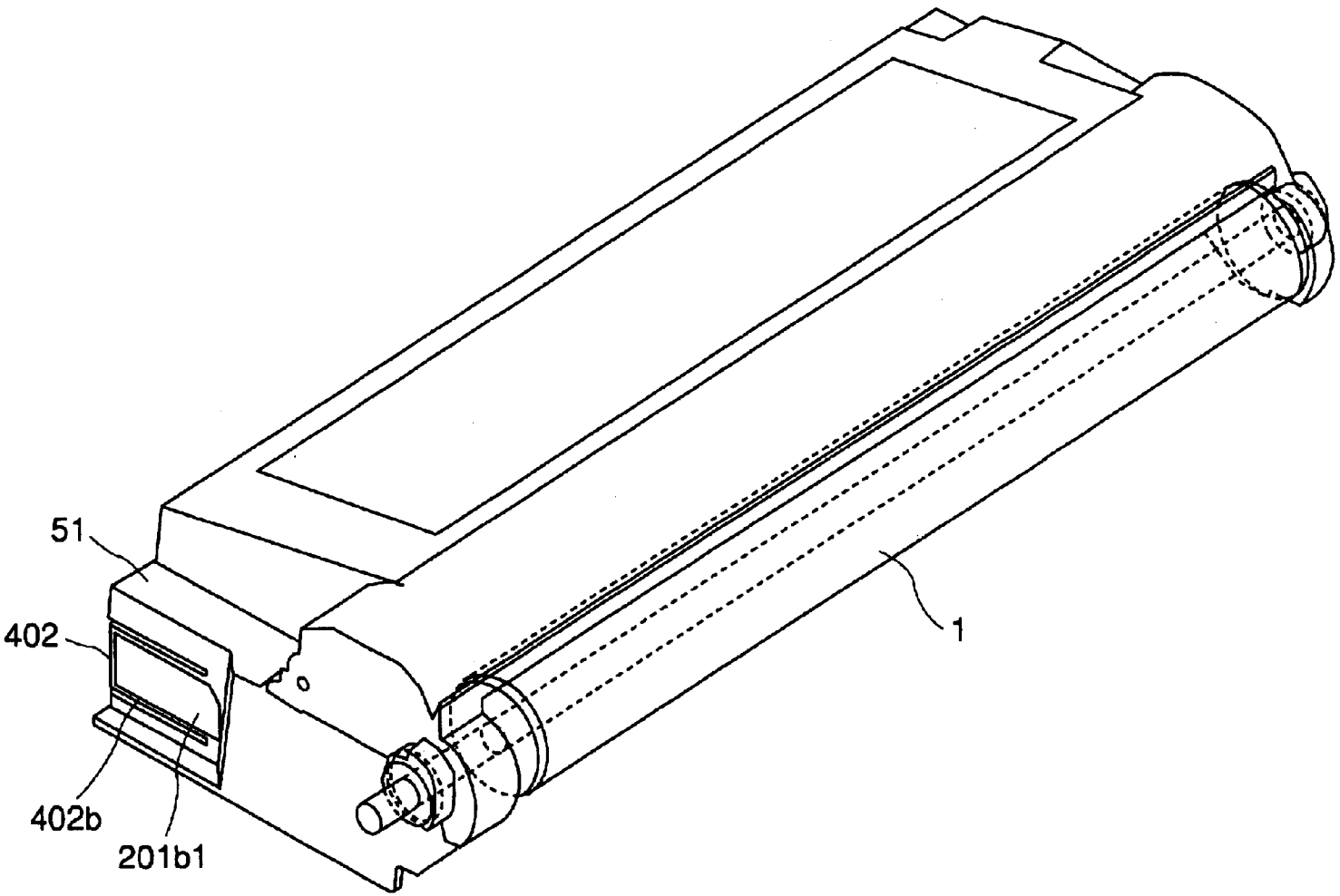
FIG. 13 a perspective view of the process cartridge in the second embodiment of the present invention, for showing the left, front, and top sides of the process cartridge.
Figure 14:
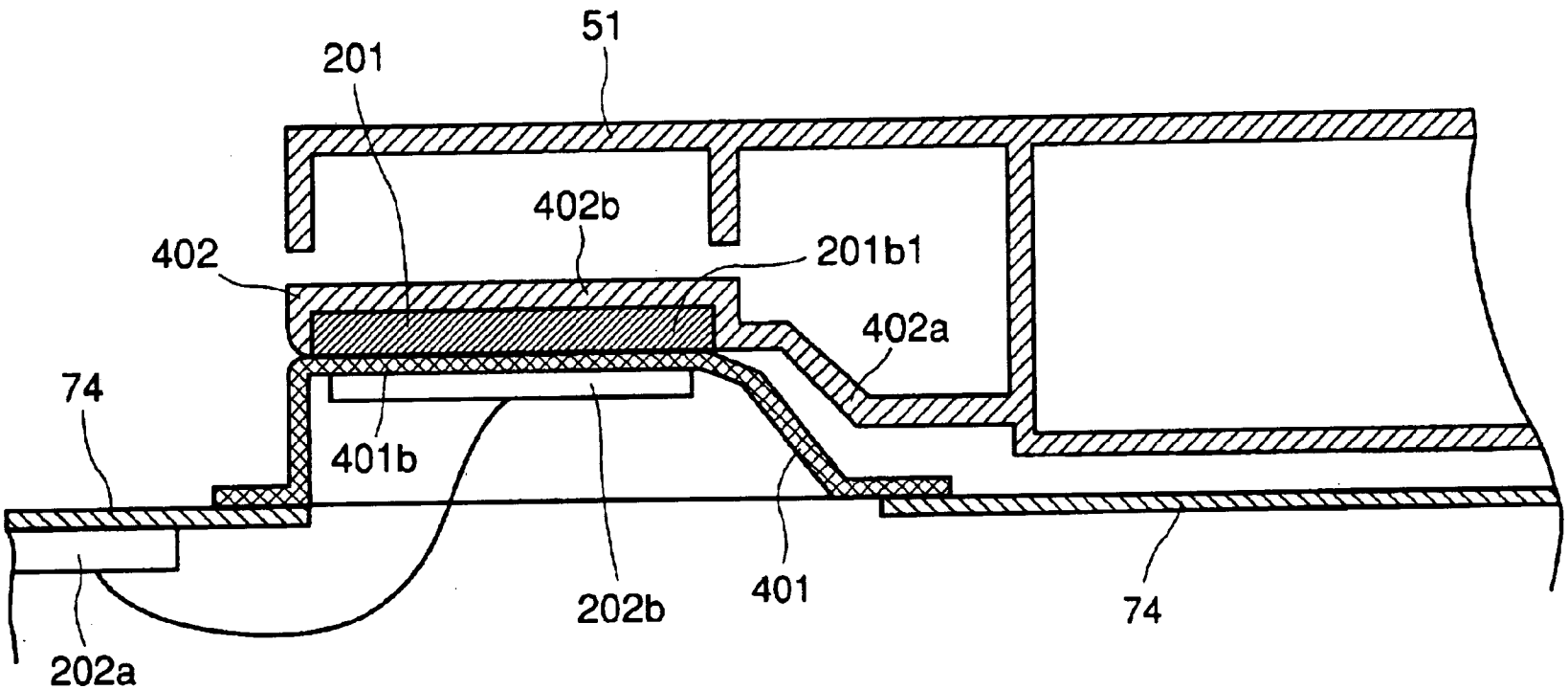
FIG. 14 is a sectional view of the thrust generating structure of the process cartridge.

Referring to FIGS. 13 and 14, the second embodiment of the present invention will be described regarding the positioning of the process cartridge 7 in terms of the thrust direction (axial direction of photoconductive drum 1). It is assumed that the reference for accurately positioning the process cartridge 7 in terms of the thrust direction is also on the right side plate side as it is in the first embodiment. The left side plate 74 is provided with a cartridge thrust bearing portion 401, which is formed of a resin and is solidly fixed to the left side plate 74. In comparison, the process cartridge 7 is provided with a pressing portion 402 (thrust generating portion) integral with the cleaner unit frame 51. The pressing portion 402 (thrust generating portion) opposes the above described cartridge thrust bearing portion 401 of the left side plate 74.

As the process cartridge 7 is inserted into the apparatus main assembly 100, the pressing portion 402 (thrust generating portion) of the cartridge 7 presses on the cartridge thrust bearing portion 401 of the apparatus main assembly 100, resiliently bending. As a result, the butting portion 51*i* of the cleaner unit frame 51 is kept butted against the cartridge catching portion 100*b* of the right side plate 75 by the thrust generated in the thrust direction of the photoconductive drum 1 by the resiliency of the pressing portion 402 (thrust generating portion) of the cartridge 7; in other words, the position of the process cartridge 7 in terms of the thrust direction remains accurately fixed (FIG. 6). The pressing portion 402 (thrust generating portion) of the process cartridge 7 is an integral part of the cleaner unit frame 51 formed of polystyrene resin, and is in the form of a cantilever. It comprises a springy portion 402*a*, that is, the portion next to the main structure of the cleaner unit frame 51, and the actual pressing portion 402*b*, that is, the portion extending from the springy portion 402*a*. When the process cartridge 7 is properly situated in the apparatus main assembly 100, the pressing portion 402*b* and cartridge thrust bearing portion 401 opposes each other, with the springy portion 402*a* remaining resiliently bent so that the springy portion generates pressure in the thrust direction (lengthwise direction of process cartridge).

To the actual pressing portion 402*b*, the memory unit 201 is attached by two-sided adhesive tape or the like means. The actual pressing portion 402*b* is the surface 201*b*1 of the memory housing 201*b*, which faces the apparatus main assembly 100. In comparison, to the antenna unit 202*b* as the antenna on the main assembly side is attached to the cartridge thrust bearing portion 401 of the apparatus main assembly 100. In other words, the cartridge thrust bearing portion 401 has the cartridge facing surface 401*a* and antenna unit facing surface 401*b*, and the antenna unit 202*b* is kept pressed upon the antenna unit facing surface 401*b* by an unshown pressure applying means.

With the provision of the above described structural arrangement, the distance between the memory communication antenna 201*a*2 of the process cartridge 7, and the antenna unit 202*b* of the apparatus main assembly 100, is regulated, as in the first embodiment, producing effects similar to those in the first embodiment.

As described above, according to the preceding embodiments, the communication between the memory unit of the process cartridge and communication unit of the image forming apparatus main assembly is carried out through the noncontact electrical communication system, eliminating the problems associated with a contact communication system; for example, the problem that the mechanical connectors required by a contact communication system in order to transmit information between a process cartridge and the main assembly of an electrophotographic image forming apparatus add to the increase in the sizes of a process cartridge and an electrophotographic image forming apparatus, or the problem that the communication between a process cartridge and the main assembly of an electrophotographic image forming apparatus becomes unsatisfactory due to mechanical issues such as contact failure. Also according to the preceding embodiments, the antenna unit of the apparatus main assembly side is integrally attached to the cartridge thrust bearing member provided as the member for pressing on the process cartridge, and the cartridge is structured so that the surface of its memory unit, which faces the cartridge thrust bearing member of the apparatus main assembly when the cartridge is in the apparatus main assembly, doubles as the portion which presses on the cartridge thrust bearing member of the apparatus main assembly. Therefore, the cartridge and its memory unit can be accurately positioned relative to the apparatus main assembly at the same time by the single mechanism, eliminating the need for providing a separate mechanism for positioning the memory unit.

According to the present invention, not only can a cartridge be accurately positioned relative to the main assembly of an electrophotographic image forming apparatus, but also the memory unit of the cartridge can be accurately positioned relative to the main assembly of the image forming apparatus.

While the invention has been described with reference to the structures disclosed herein, it is not confined to the details set forth, and this application is intended to cover such modifications or changes as may come within the purposes of the improvements or the scope of the following claims.

What is claimed is:

1. A process cartridge detachably mountable to a main assembly of an electrophotographic image forming apparatus, comprising:

an electrophotographic photosensitive drum;

process means actable on said electrophotographic photosensitive drum;

a memory member for storing information about said process cartridge and for communicating with communicating means provided in the main assembly of the electrophotographic image forming apparatus;

wherein said memory member is provided on a cartridge surface of said process cartridge which crosses with an axis of said electrophotographic photosensitive drum, and when said process cartridge is mounted to the main assembly of the apparatus, said process cartridge is urged by an urging member provided in the main assembly in a direction from a side provided with said memory member to a side opposite therefrom.

2. A process cartridge according to claim 1, wherein the cartridge surface is opposite from an abutment surface of said process cartridge which is abuttable to the main assembly of the electrophotographic image forming apparatus for positioning of said electrophotographic photosensitive drum in the direction of the axis.

3. A process cartridge according to claim 2, wherein the cartridge surface is adapted to oppose the urging member provided in the main assembly of the electrophotographic image forming apparatus to urge said process cartridge, thus abutting the process cartridge to the main assembly of the electrophotographic image forming apparatus, for positioning of said electrophotographic photosensitive drum in the direction of the axis.

4. A process cartridge according to claim 1, 2 or 3, wherein said memory member includes a base member; a memory storing element, provided on said base member, for storing information; a memory antenna, provided in said base member, for sending information stored in said memory storing element to a main assembly antenna provided in the main assembly of the image forming apparatus when said process cartridge is mounted to the main assembly of the image forming apparatus; a sending member, provided in said base member, for transmitting information stored in said memory storing element to said memory antenna; and a memory outside casing for casing said base member, said memory storing element, said sending member and said memory antenna.

5. An electrophotographic image forming apparatus for forming an image on a recording material, to which a process cartridge is detachably mountable, comprising:

mounting means for detachably mounting the process cartridge, said process cartridge including:

an electrophotographic photosensitive drum, process means actable on said electrophotographic photosensitive drum, and a memory member for storing information about said process cartridge and for communicating with communicating means provided in the main assembly of the electrophotographic image forming apparatus, wherein said memory member is provided on a cartridge surface of said process cartridge which crosses with an axis of said electrophotographic photosensitive drum, and when said process cartridge is mounted to the main assembly of the apparatus, said process cartridge is urged by an urging member provided in the main assembly in a direction from a side provided with said memory member to a side opposite therefrom;

feeding means for feeding the recording material; and a main assembly antenna for receiving data sent from said memory member, wherein said urging member is disposed at a position opposed to said memory member and urges said process cartridge in a direction of the axis of said electrophotographic photosensitive drum to position said process cartridge relative to the main assembly of said image forming apparatus in the direction of the axis.

6. A process cartridge detachably mountable to a main assembly of an electrophotographic image forming apparatus, comprising:

an electrophotographic photosensitive drum;

process means actable on said photosensitive drum; and a memory member for storing information about said process cartridge to communicate with a main assembly antenna provided in the main assembly of the apparatus, said memory member being disposed on one end surface of said process cartridge with respect to an axial direction of said electrophotographic photosensitive drum, and comprising a memory antenna, wherein when said process cartridge is mounted to the main assembly of the apparatus, said one end surface is pressed by an urging member provided in the main assembly of the apparatus, and the main assembly antenna is provided in the urging member, wherein when said urging member urges said one end surface, said memory antenna and said main assembly antenna are opposed to each other.

7. A process cartridge according to claim 6, wherein when said urging member urges said one end surface, a memory outside casing of said memory member and an urging portion of said urging member are contacted to each other to maintain a gap between said memory antenna and said main assembly antenna.

8. A process cartridge according to claim 6 or 7, wherein said memory member is provided on a cleaning frame, and said cleaning frame contains said photosensitive drum, a charging member for electrically charging said photosensitive drum, and a cleaning member for removing developer remaining on said photosensitive drum.

9. A process cartridge according to claim 8, further comprising a developing frame containing a developing roller for developing a latent image formed on said photosensitive drum, wherein said cleaning frame and said developing frame are rotatably coupled with each other.

10. A process cartridge according to claim 6 or 7, wherein said memory member includes a base member; a memory storing element, provided on said base member, for storing information; a sending member, provided on said base member, for sending the information stored in said memory storing element to said memory antenna; and a memory outside outer casing member for casing said base member, said storing element, said sending member and said memory antenna.

11. A process cartridge detachably mountable to a main assembly of an electrophotographic image forming apparatus, comprising:

an electrophotographic photosensitive drum;

process means actable on said photosensitive drum;

a developing frame containing a developing roller for developing a latent image formed on said photosensitive drum; and a memory member for storing information about said process cartridge to communicate with a main assembly antenna provided in the main assembly of the apparatus, said memory member being disposed on one end surface of said process cartridge with respect to an axial direction of said electrophotographic photosensitive drum, and comprising a memory antenna, wherein when said process cartridge is mounted to the main assembly of the apparatus, said one end surface is pressed by an urging member provided in the main assembly of the apparatus, and the main assembly antenna is provided in the urging member, wherein when said urging member urges said one and surface, said memory antenna and said main assembly antenna are opposed to each other, wherein said memory member is provided on a cleaning frame, and said cleaning frame contains said photosensitive drum, a charging member for electrically charging said photosensitive drum, and a cleaning member for removing developer remaining on said photosensitive drum, wherein said memory member includes a base member; a memory storing element, provided on said base member, for storing information; a sending member, provided on said base member, for sending the information stored in said memory storing element to said memory antenna; and a memory outside casing member for casing said base member, said memory storing element, said sending member and said memory antenna, and wherein said cleaning frame and said developing frame are rotatably coupled with each other.

12. A process cartridge according to claim 11, wherein when said urging member urges said one end surface, the memory outside casing of said memory member and an urging portion of said urging member are contacted to each other to maintain a gap between said memory antenna and said main assembly antenna.

13. An electrophotographic image forming apparatus for forming an image on a recording material, to which a process cartridge is detachably mountable, said apparatus comprising:

(i) a main assembly antenna;

(ii) an urging member;

(iii) a mounting portion for mounting the process cartridge, the process cartridge including:

an electrophotographic photosensitive drum;

process means actable on said photosensitive drum; and a memory member for storing information about said process cartridge to communicate with the main assembly antenna provided in the main assembly of the apparatus, said memory member being disposed on one end surface of said process cartridge with respect to an axial direction of said electrophotographic photosensitive drum, and comprising a memory antenna, wherein when said process cartridge is mounted to the main assembly of the apparatus, said one end surface is pressed by the urging member provided in the main assembly of the apparatus, and the main assembly antenna is provided in the urging member, wherein when said urging member urges said one end surface, said memory antenna and said main assembly antenna are opposed to each other.

14. A process cartridge according to claim 13, wherein when said urging member urges said one end surface, a memory outside casing of said memory member and an urging portion of said urging member are contacted to each other to maintain a gap between said memory antenna and said main assembly antenna

15. A process cartridge detachably mountable to a main assembly of an electrophotographic image forming apparatus, comprising:

an electrophotographic photosensitive drum;

process means actable on said electrophotographic photosensitive drum; and a memory member for storing information about said process cartridge to communicate with the main assembly of the apparatus, said memory member being disposed on one end surface of said process cartridge with respect to a direction of an axis of said electrophotographic photosensitive drum, an abutment surface being disposed on the other end surface of said process cartridge with respect to the direction of the axis of said electrophotographic photosensitive drum, and said abutment surface is abuttable to the main assembly of the electrophotographic image forming apparatus for positioning of said electrophotographic photosensitive drum in the direction of the axis, wherein when said process cartridge is mounted to the main assembly of the apparatus, said one end surface is urged by an urging member provided in the main assembly of the apparatus toward the other end surface.

16. A process cartridge according to claim 15, wherein the main assembly of the apparatus includes a main assembly antenna, and wherein said memory member includes a memory antenna which is communicable with said main assembly antenna, wherein when said urging member urges said one end surface, a memory outside casing of said memory member and an urging portion of said urging member are contacted to each other to maintain a gap between said memory antenna and said main assembly antenna.

17. A process cartridge according to claim 16, wherein said memory antenna and said main assembly antenna are opposed to each other with said urging member interposed therebetween.

* * * * *

UNITED STATES PATENT AND TRADEMARK OFFICE

CERTIFICATE OF CORRECTION

PATENT NO. : 6,947,685 B2
APPLICATION NO. : 10/329476
DATED : September 20, 2005
INVENTOR(S) : Arimitsu et al.

It is certified that error appears in the above-identified patent and that said Letters Patent is hereby corrected as shown below:

COLUMN 1
Line 35, “a least” should read --at least--.

COLUMN 2
Line 53, “above described” should read --above-described--.

COLUMN 4
Line 60, “4d0” should read --4d)--.

COLUMN 5
Line 8, “above mentioned” should read --above-mentioned--.

COLUMN 6
Line 3, “remain” should read --remains--.

COLUMN 11
Line 64, “above described” should read --above-described--.

COLUMN 12
Line 22, “above described” should read --above-described--.

COLUMN 13
Line 3, “above” should read --above- --.

COLUMN 14
Line 9, “in” should be deleted.

COLUMN 15
Line 32, “above” should read --above- --.

COLUMN 16
Line 5, “above described” should read --above-described--.

COLUMN 18
Line 63, “and” should read --end--.

UNITED STATES PATENT AND TRADEMARK OFFICE

CERTIFICATE OF CORRECTION

PATENT NO. : 6,947,685 B2
APPLICATION NO. : 10/329476
DATED : September 20, 2005
INVENTOR(S) : Arimitsu et al.

It is certified that error appears in the above-identified patent and that said Letters Patent is hereby corrected as shown below:

COLUMN 20
Line 6, "antenna" should read --antenna.--.

Signed and Sealed this

Fifth Day of June, 2007

JON W. DUDAS
*Director of the United States Patent and Trademark Office*